US006652057B2

(12) United States Patent
Masuda et al.

(10) Patent No.: US 6,652,057 B2
(45) Date of Patent: Nov. 25, 2003

(54) PRINTING APPARATUS

(75) Inventors: Kazunori Masuda, Saitama (JP); Kiyoshi Sekiguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/059,440

(22) Filed: Jan. 31, 2002

(65) Prior Publication Data

US 2002/0145639 A1 Oct. 10, 2002

(30) Foreign Application Priority Data

| | | |
|---|---|---|
| Jan. 31, 2001 | (JP) | 2001-024444 |
| Nov. 14, 2001 | (JP) | 2001-348643 |
| Jan. 31, 2002 | (JP) | 2002-022948 |

(51) Int. Cl.[7] ..... B41J 29/38
(52) U.S. Cl. ..... 347/14; 347/9; 347/17
(58) Field of Search ..... 347/14, 9, 17

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,459,600 A | | 7/1984 | Sato et al. | 346/140 |
| 4,463,359 A | | 7/1984 | Ayata et al. | 346/1.1 |
| 4,558,333 A | | 12/1985 | Sugitani et al. | 346/140 |
| 4,563,691 A | * | 1/1986 | Noguchi et al. | 346/76 |
| 4,608,577 A | | 8/1986 | Hori | 346/140 |
| 4,723,129 A | | 2/1988 | Endo et al. | 346/1.1 |
| 4,740,796 A | | 4/1988 | Endo et al. | 346/1.1 |
| 4,982,199 A | * | 1/1991 | Dunn | 346/1.1 |
| 5,053,790 A | * | 10/1991 | Stephenson et al. | 346/76 |
| 5,363,134 A | * | 11/1994 | Barbehenn et al. | 347/49 |
| 6,024,430 A | * | 2/2000 | Koitabashi et al. | 347/17 |
| 6,113,213 A | * | 9/2000 | Hosaka | 347/20 |
| 6,116,710 A | * | 9/2000 | Tajika et al. | 347/14 |

FOREIGN PATENT DOCUMENTS

| | | |
|---|---|---|
| EP | 0 642925 A2 * | 3/1995 |
| EP | 0 750 988 | 1/1997 |
| JP | 54-56847 | 5/1979 |
| JP | 59-123670 | 7/1984 |
| JP | 59-138461 | 8/1984 |
| JP | 60-71260 | 4/1985 |
| JP | 9-11463 | 1/1997 |

* cited by examiner

*Primary Examiner*—Stephen D. Meier
*Assistant Examiner*—Lam Nguyen
(74) *Attorney, Agent, or Firm*—Fitzpatrick, Cella, Harper & Scinto

(57) ABSTRACT

A printing apparatus performs printing by scanning a carriage unit over a print medium based on information transmitted from an external apparatus. The body of the carriage unit includes a removable printhead having a plurality of nozzles for discharging ink; a heat source detection unit for detecting the number of heat sources driving the nozzles; and a voltage generation unit for supplying a voltage to the heat sources for driving the nozzles in accordance with the number of heat sources detected by the heat source detection unit.

4 Claims, 17 Drawing Sheets

PRINTING APPARATUS

FIELD OF THE INVENTION

The present invention relates to a printing apparatus comprising a DC power source device, which drives a printhead (recording head) of an inkjet printer.

BACKGROUND OF THE INVENTION

An inkjet printing method is advantageous because it enables high-speed printing, makes almost no noise at the time of printing, enables direct printing on regular paper and does not require a fixing process so as to enable downsizing of a printer. Owing to these advantages, commercialization of the inkjet printing method is increasing. The inkjet printing method includes: a method which utilizes an electric/mechanical converter for jetting an ink droplet from a nozzle by making use of a motion caused by mechanical changes induced by input signals; and a so-called thermal inkjet method employing electrothermal transducers (heating resistances) for discharging an ink droplet by a pressure of bubbles generated on the heating resistances which generate heat upon application of a voltage pulse.

A known ink discharge method of an inkjet printer is to heat resistances or resistors by electric power applied to a printhead and discharge ink from a micro-nozzle by utilizing bubbles generated within the nozzle serving as an ink channel. In this case, to drive a printhead for discharging ink, a constant DC voltage is applied to the resistances to turn on/off switch devices connected in series to the resistances, thereby supplying the amount of power necessary for ink ejection to the heater resistances.

The printhead of an inkjet printer, which has a removable configuration, is held in a carriage unit moving in accordance with a width of a print medium, e.g., paper, at the time of printing. Therefore, a printhead set in a printer is not always the same. For instance, a printhead for printing black and white images, a printhead for printing color images, and so on, may be used for its purpose.

Since an arbitrary printhead is mounted as described above, the amount of head driving power necessary for discharging ink in a single discharge operation is controlled in order to stabilize the printing operation regardless of a variation in resistance values of the heater resistances in the printhead. Conventionally, the amount of electric power is controlled by detecting a variation of the heater resistance values based on a resistance value of a detection resistance, provided within the printhead that includes the heater resistances, then inputting the variation data to a control circuit provided on a main board fixed to a printer main body, and adjusting a head driving pulsewidth transmitted from the main board to the printhead.

Furthermore, an amount of heater driving power is also controlled by detecting a temperature rise in a printhead with the use of a thermometer, provided within the printhead that includes the heater resistances, and adjusting a head driving pulsewidth transmitted from the main board to the printhead.

Note that the DC voltage applied to the heater resistances is supplied as a constant voltage from an AC adapter or a DC power source device provided within a printer.

FIG. 7 is a block diagram showing a brief construction of an example of a conventional inkjet printer. In FIG. 7, reference numeral 51 denotes an inkjet printhead; 52, a head carriage circuit board; 53, a head carriage; 54, a flexible cable; 55, a main board of the printer main body; 56, a driving pulse control circuit included in the main board 55; 57, a power source; and 58, a host apparatus.

The inkjet printhead 51, having a plurality of heating resistances, performs printing by discharging an ink droplet from a nozzle by making use of a pressure of bubbles, generated by converting energy to heat, the energy being supplied from the power source 57 in accordance with controlling of the driving pulse control circuit 56 in the main board 55.

The main board 55 converts an image signal, transmitted from the external host apparatus 58, to a bit signal which turns on/off each of the heating resistances in accordance with, for instance, a print mode or the like, and transmits the bit signal to the driving pulse control circuit 56 for generating a driving pulse. The driving pulse consists of, e.g., a heat source selection signal, printing serial signal, and so forth. The pulsewidth of the driving pulse is changed in accordance with information, such as a temperature of the inkjet printhead 51, so as to perform most appropriate ink droplet discharge.

The generated driving pulse is transmitted to the head carriage 53 through a movable cable such as the flexible cable 54, and transmitted to the inkjet printhead 51 through the head carriage circuit board 52. The inkjet printhead 51 is constructed with one or more removable head units. The head carriage 53 is structured such that it is movable. The head carriage circuit board 52 mainly serves as a relay for electrically connecting the flexible cable 54 with the inkjet printhead 51.

The power source 57 adopts an AC/DC converter having plural outputs for supplying a power source voltage to logical circuits such as the main board 55, motors (not shown), and inkjet printhead 51. Voltage precision is required particularly for the voltage supplied to the inkjet printhead 51, in view of an influence of a voltage drop caused by wiring resistances generated as a result of passing through the long flexible cable 54 and also for stable ink droplet discharge.

FIG. 8 is an explanatory view of connection between heating resistances and driving switches in the example of the conventional inkjet printhead.

In FIG. 8, reference numeral 16 denotes a heating resistance; 17, a driving switch; and 18, a power source line connected to a power source. Reference numeral 19 denotes a heating resistance driving circuit connector. One end of the heating resistance 16 is connected to the power source line 18 which receives voltage supplies from the power source, and the other end is connected to the driving switch 17.

Assume herein that the inkjet printhead has 64 nozzles. One end of the heating resistance 16, corresponding to each of the 64 nozzles, is connected to the power source line 18 which supplies a driving voltage, while the other end of the heating resistance 16 is connected to the driving switch 17. The heating resistance driving circuit connector 19 is connected to a heating resistance driving circuit (not shown) for being controlled such that a current is sent only to the heating resistances 16 selected in accordance with the heat source selection signal or printing serial signal transmitted from the main board. Note in FIG. 8, nozzles are numbered (N#1 to N#64) from the left.

FIG. 8 shows an example in which the 64 nozzles are divided into 8 blocks each having 8 nozzles, and nozzles are driven in block unit. In FIG. 8, nozzles N#1 to N#8 are included in block 1, N#9 to N#16 are in block 2, . . . , and N#57 to N#64 are in block 8.

Depending on an image to be printed, 8 nozzles in each block may be driven simultaneously. Among the signals outputted from the driving pulse control circuit 56, the heat source selection signal is used for determining a block to be driven in the 8 blocks, and the printing serial signal is used for selecting a nozzle discharging ink from the 64 nozzles. The amount of current sent through the power source line differs in accordance with the number of nozzles driven simultaneously. Therefore, even in a case of driving one block, a voltage drop level caused by wiring resistances is different depending on the number of nozzles driven in the block. Also, a sudden variation in the amount of current affects the voltage drop level.

As mentioned above, a voltage drop level differs in accordance with the number of nozzles driven in each block. Conventionally, the voltage drop level is corrected by controlling a driving pulsewidth so as to supply uniform heating energy (power) to the heating resistances of the nozzles. This construction is disclosed in, e.g., Japanese Patent Application Laid-Open No. 9-11463.

According to a conventional printhead driving method, a DC voltage for driving a printhead is supplied to the printhead through a flexible board, which connects the main board with a movable carriage board. The flexible board has a long wiring structure because it requires at least a length corresponding to the stroke of printhead's movement. Supplying a DC voltage for driving the printhead through such long wiring causes a problem of a voltage drop due to a wiring impedance. Because a head driving current is increasing in response to demands for high-speed and high-quality printers, an influence of the aforementioned voltage drop has come to the fore.

Furthermore, as means to control the amount of head driving power necessary for discharging ink in a single discharge operation, a method of adjusting a driving pulsewidth in accordance with a state of a printhead is adopted. However with this method, it is necessary to secure a maximum time width for a pulsewidth driving the heaters so as to make correction on the pulsewidth in accordance with various factors. This causes a problem of limiting the number of nozzles which can be used for printing per unit time, and as a result, limiting printing speed.

In addition, as mentioned above, a level of voltage drop caused in accordance with the number of nozzles driven in each block is corrected by controlling a driving pulsewidth so as to supply uniform energy to heating resistances of the nozzles. However, according to this method, it is controlled such that a driving pulsewidth is increased when a large number of nozzles is driven simultaneously. This makes a pulsewidth large (in other words, long time), holding from increasing the speed of an inkjet printer.

SUMMARY OF THE INVENTION

The present invention has been proposed in view of the conventional problems, and has as its object to provide a printing apparatus integrally comprising control means on a carriage unit, for continuously supplying a stable amount of power necessary to control printing operation without controlling a head driving pulsewidth, by variably controlling a driving voltage for driving a printhead.

Another object of the invention is to provide an inkjet printing apparatus, which comprises means for having an inkjet printhead detect a variation of a plurality of heat source elements and having a DC/DC converter detect the number of simultaneously-driven heat sources, and which performs controlling by making an output voltage of the DC/DC converter variable in accordance with detected information so as to control the amount of power supplied to heating resistances (heater resistances) to the most appropriate value for ink discharge.

In order to achieve the above objects, a printing apparatus according to the present invention has the following configuration.

More specifically, the present invention provides a printing apparatus which performs printing by scanning a carriage unit, having a printhead and a voltage control unit controlling the printhead, over a print medium based on information transmitted by an external apparatus, the voltage control unit comprising: reception means for receiving an information signal transmitted from the printhead; and voltage generation means for generating a driving voltage which is adjusted to drive the printhead based on the information signal received by the reception means.

According to an aspect of the present invention, the voltage generation means is a DC/DC converter which transforms a DC voltage to be applied to the printhead into a value appropriate for driving a mounted head.

According to another aspect of the present invention, the information signal includes an identification signal for identifying a type of the printhead, and the voltage generation means controls the driving voltage in accordance with the identification signal.

According to another aspect of the present invention, the information signal includes a signal indicative of a variation of a plurality of heater resistances provided in the printhead, and the voltage generation means controls the driving voltage in accordance with the signal.

According to another aspect of the present invention, the information signal includes a signal indicative of temperature data of the printhead, and the voltage generation means controls the driving voltage in accordance with the signal.

According to another aspect of the present invention, a detection resistance is provided inside the printhead for detecting a variation of the heater resistances, and the voltage generation means comprises an internal resistance connected in series with the detection resistance, wherein the voltage generation means compares a reference voltage, divided by the internal resistance and the detection resistance, with a driving voltage which drives the printhead, then controls the driving voltage so as to cancel an error in these voltages, and adjusts the driving voltage in accordance with a variation of a load resistance value of the printhead so as to correct the variation.

According to another aspect of the present invention, the printhead includes a diode for detecting a temperature, and the voltage generation means comprises an internal resistance connected in series with the diode, wherein the voltage generation means compares a reference voltage, divided by the internal resistance, detection resistance provided inside the printhead, and diode, with a driving voltage which drives the printhead, then corrects an error in these voltages, and generates a control voltage for optimizing power supplied to heat the printhead, so as to discharge ink in accordance with a temperature variation of the printhead.

According to another aspect of the present invention, the printing apparatus further comprises: a plurality of heat sources for generating bubble generation heat for driving in nozzle unit; driving pulse generation means for generating a pulse train which drives the plurality of heat sources; and heat source number detection means for detecting a number of plurality of heat sources driven simultaneously, wherein the voltage generation means adjusts a voltage outputted to the heat sources based on a signal from the heat source number detection means.

According to another aspect of the present invention, the heat source number detection means detects the number of plurality of heat sources driven simultaneously based on an image data signal.

Furthermore, according to the present invention, the foregoing object is achieved by providing a printing apparatus which performs printing by scanning a carriage unit, capable of holding a printhead having a plurality of nozzles discharging ink, over a print medium based on information transmitted from an external apparatus, a body of the carriage unit comprising: heat source detection means for detecting a number of heat sources driving the nozzles; and voltage generation means for supplying a voltage to a heat source for driving the nozzles, in accordance with the number of heat sources detected by the heat source detection means.

Still further, according to the present invention, the foregoing object is achieved by providing a printing apparatus forming an image on a print medium by supplying an electric energy necessary for printing to a heating resistance of a printhead, comprising: a switching device for controlling each heating resistance; a printhead including a detection resistance for detecting a variation of a resistance value of the heating resistances; a voltage variable circuit for adjusting a power source voltage, applied to the heating resistance, in accordance with the resistance value of the detection resistance so as to apply energy appropriate for printing; and a head driving power source circuit for comparing a first voltage value, generated by dividing a reference voltage by the detection resistance and a resistance provided outside the printhead, with a second voltage value, generated by dividing an output voltage of the head driving power source driving the printhead by a resistance, and controlling an output voltage so as to cancel a difference between the first voltage value and the second voltage value, wherein a GND-side end of the detection resistance provided inside the printhead is connected as a common wiring with a GND wiring transmitting a driving current of the printhead.

According to an aspect of the present invention, the GND-side end of the detection resistance connects with the common wiring transmitting a load current in an internal portion of the printhead, and the detection resistance does not have a dedicated outgoing contact pad on a GND-side terminal.

According to another aspect of the present invention, in a case where the GND-side end of the detection resistance connects with the common wiring transmitting a load current in an external portion of the printhead, the connection position is located in the middle of the printhead and an output voltage stable point of the power source circuit.

According to another aspect of the present invention, a ratio of a wiring resistance value of the common wiring to a wiring resistance value of all wirings, connecting the power source circuit with the printhead and transmitting a head load current, is appropriately set in accordance with an output voltage so as to cancel a voltage drop in a load due to a wiring resistance.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Note that the following embodiments will describe a printer as an example of a printing apparatus employing an inkjet printing method.

In this specification, the term "record" (may also be referred to as "print") means not only forming significant information such as characters or graphics, but also forming images, patterns or the like on a recording medium in the broad sense, or processing a medium, regardless of whether or not the information is significant, and regardless of whether or not the information is manifested so as to be visually perceptible by human.

Furthermore, the term "print medium" means not only paper used in general printers, but also fabric, plastic or film, a metal plate, glass, ceramic, wood, leather, or anything that can be printed with ink.

Moreover, the term "ink" (may also be referred to as "liquid") should be interpreted in the broad sense, similar to the foregoing definition of "record" (print). More specifically, ink means liquid provided on a print medium for forming images, patterns or the like, or processing a print medium, or processing ink (e.g., solidifying or insolubilizing a colorant included in ink to be provided on a print medium).

Brief Description of Apparatus Main Unit

Figure 9:
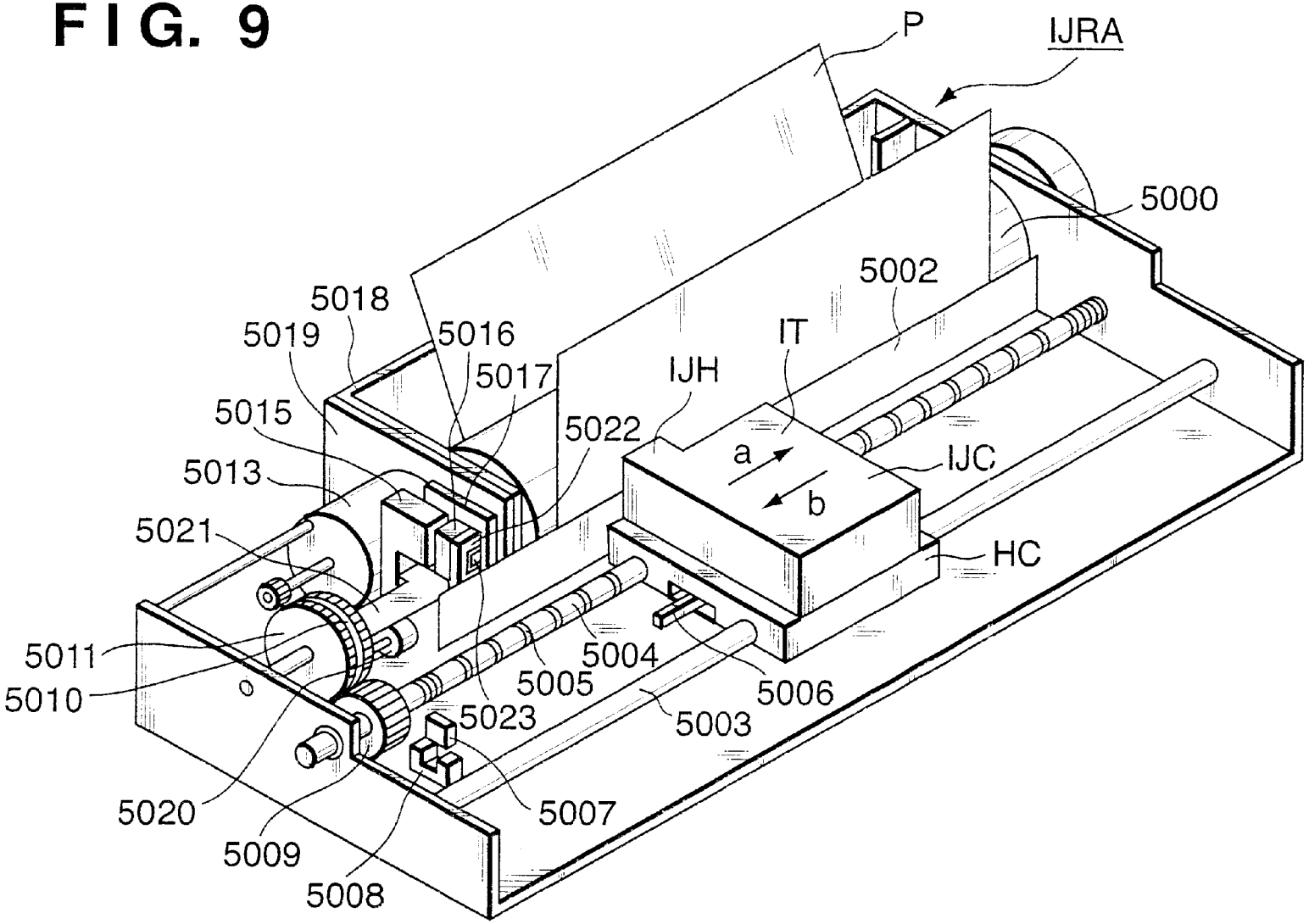
FIG. 9 is an external view of a printer according to a preferable embodiment of the present invention.

FIG. 9 is a perspective view showing the outer appearance of an inkjet printer IJRA as a typical embodiment of the present invention. Referring to FIG. 9, a carriage HC engages with a spiral groove 5005 of a lead screw 5004, which rotates via driving force transmission gears 5009 to 5011 upon forward/reverse rotation of a driving motor 5013. The carriage HC has a pin (not shown), and is reciprocally scanned in the directions of arrows a and b in FIG. 9. An integrated inkjet cartridge IJC which incorporates a printhead IJH and an ink tank IT is mounted on the carriage HC.

Reference numeral 5002 denotes a sheet pressing plate, which presses a paper sheet P against a platen 5000, ranging from one end to the other end of the scanning path of the carriage HC. Reference numerals 5007 and 5008 denote photocouplers which serve as a home position detector for recognizing the presence of a lever 5006 of the carriage in a corresponding region, and used for switching, e.g., the rotating direction of the motor 5013.

Reference numeral 5016 denotes a member for supporting a cap member 5022, which caps the front surface of the printhead IJH; and 5015, a suction device for sucking ink residue through the interior of the cap member. The suction device 5015 performs suction recovery of the printhead via an opening 5023 of the cap member 5015. Reference numeral 5017 denotes a cleaning blade; 5019, a member which allows the blade to be movable in the back-and-forth direction of the blade. These members are supported by a main unit support plate 5018. The shape of the blade is not limited to this, but a known cleaning blade can be used in this embodiment.

Reference numeral 5021 denotes a lever for initiating a suction operation in the suction recovery operation. The lever 5021 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5004 when the carriage reaches the home-position side region. However, the present invention is not limited to this arrangement as long as desired operations are performed at known timings.

Description of Control Structure

Next, a control structure for executing print control in the aforementioned apparatus is described.

Figure 10:
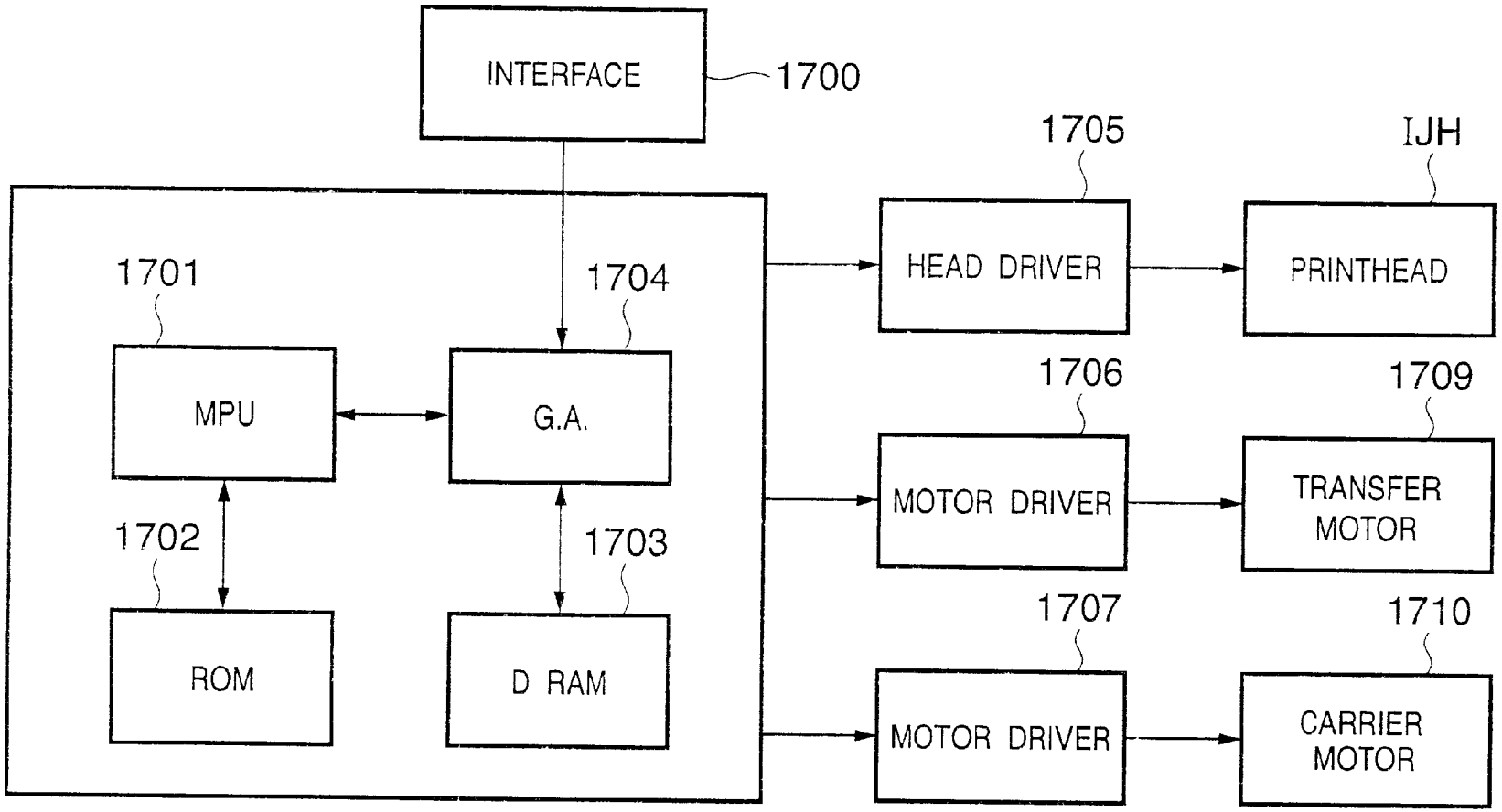
FIG. 10 is a block diagram showing a control structure of the printer shown in FIG. 9.

FIG. 10 is a block diagram showing the arrangement of a control circuit of the inkjet printer IJRA. Referring to FIG. 10 showing the control circuit, reference numeral 1700 denotes an interface for inputting a print signal; 1701, an MPU; 1702, ROM for storing a control program executed by the MPU 1701; and 1703, DRAM for storing various data (the print signal, print data supplied to the printhead, and the like). Reference numeral 1704 denotes a gate array (G.A.) for performing supply control of print data to the printhead IJH. The gate array 1704 also performs data transfer control among the interface 1700, the MPU 1701, and the RAM 1703. Reference numeral 1710 denotes a carriage motor for conveying the printhead IJH; and 1709, a transfer motor for transferring a print sheet. Reference numeral 1705 denotes a head driver for driving the printhead; and 1706 and 1707, motor drivers for driving the transfer motor 1709 and the carrier motor 1710.

The operation of the above control structure will be described below. When a print signal is input to the interface 1700, the print signal is converted into print data for printing operation between the gate array 1704 and the MPU 1701. The motor drivers 1706 and 1707 are driven, and the printhead is driven in accordance with the print data supplied to the head driver 1705, thereby performing printing operation.

Herein, although the control program executed by the MPU 1701 is stored in the ROM 1702, an erasable/programmable storage medium, e.g., EEPROM or the like, may be further added to enable changes in the control program from a host computer connected to the inkjet printer IJRA.

Note that the ink tank IT and printhead IJH may be integrally constructed as described above to form the exchangeable inkjet cartridge IJC. Alternatively, the ink tank IT and printhead IJH may be separably constructed so as to enable exchange of the ink tank IT when ink is exhausted.

Figure 11:
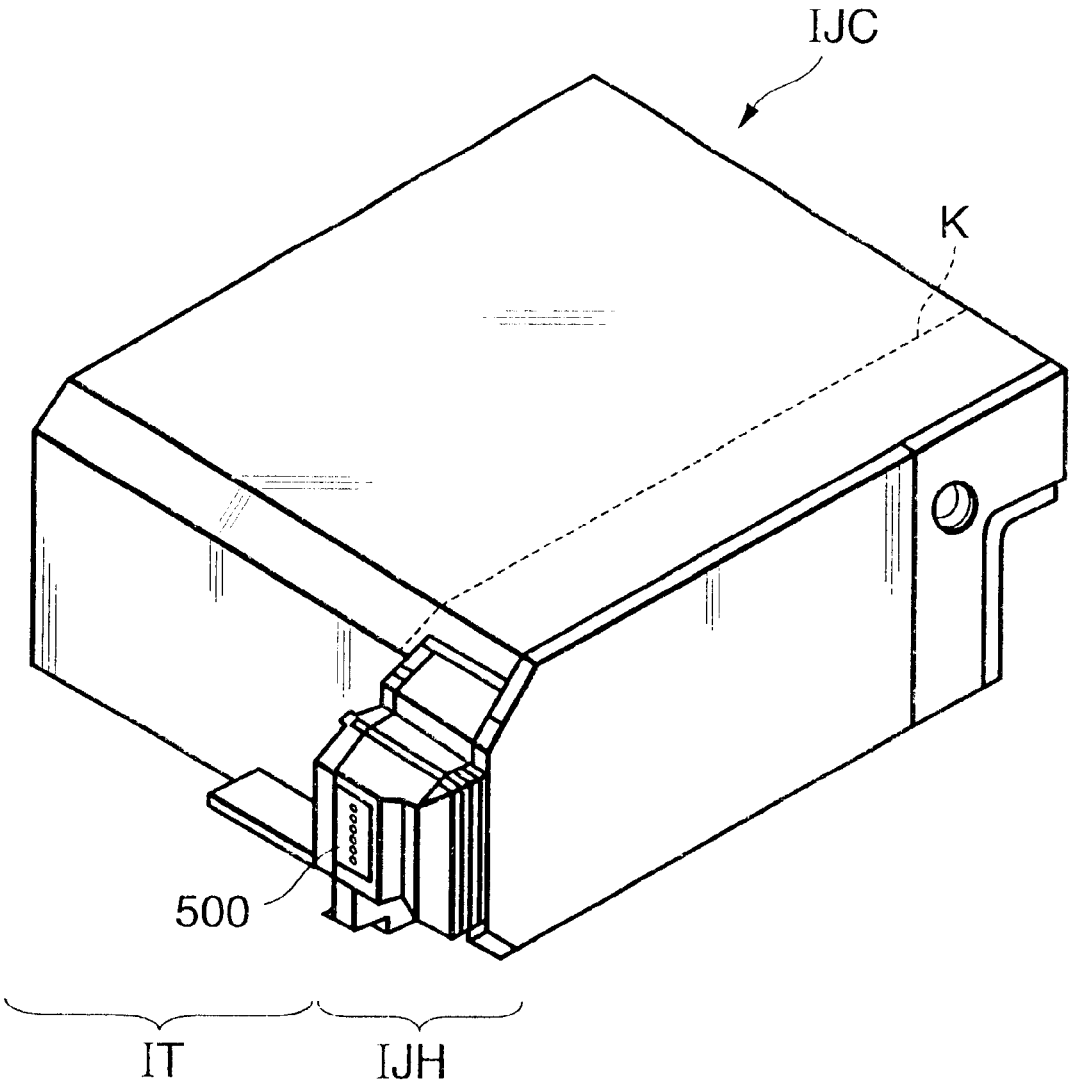
FIG. 11 shows an inkjet cartridge of the printer shown in FIG. 9.

FIG. 11 is a perspective view showing the outer appearance of the ink cartridge IJC where the printhead IJH and ink tank IT are separable. The ink tank IT can be separated from the printhead IJH at the boundary line K shown in FIG. 11. The ink cartridge IJC includes an electrical contact portion (not shown) for receiving electrical signals from the carriage HC when mounted on the carriage HC. The printhead IJH is driven for ink discharge by the received electrical signals.

Note in FIG. 11, reference numeral 500 denotes an array of ink discharge orifices. The ink tank IT includes a fibrous or porous ink absorbing member for maintaining ink.

First Embodiment

Hereinafter, a first embodiment of a printhead carriage according to the present invention is described with reference to the drawings.

Figure 1:
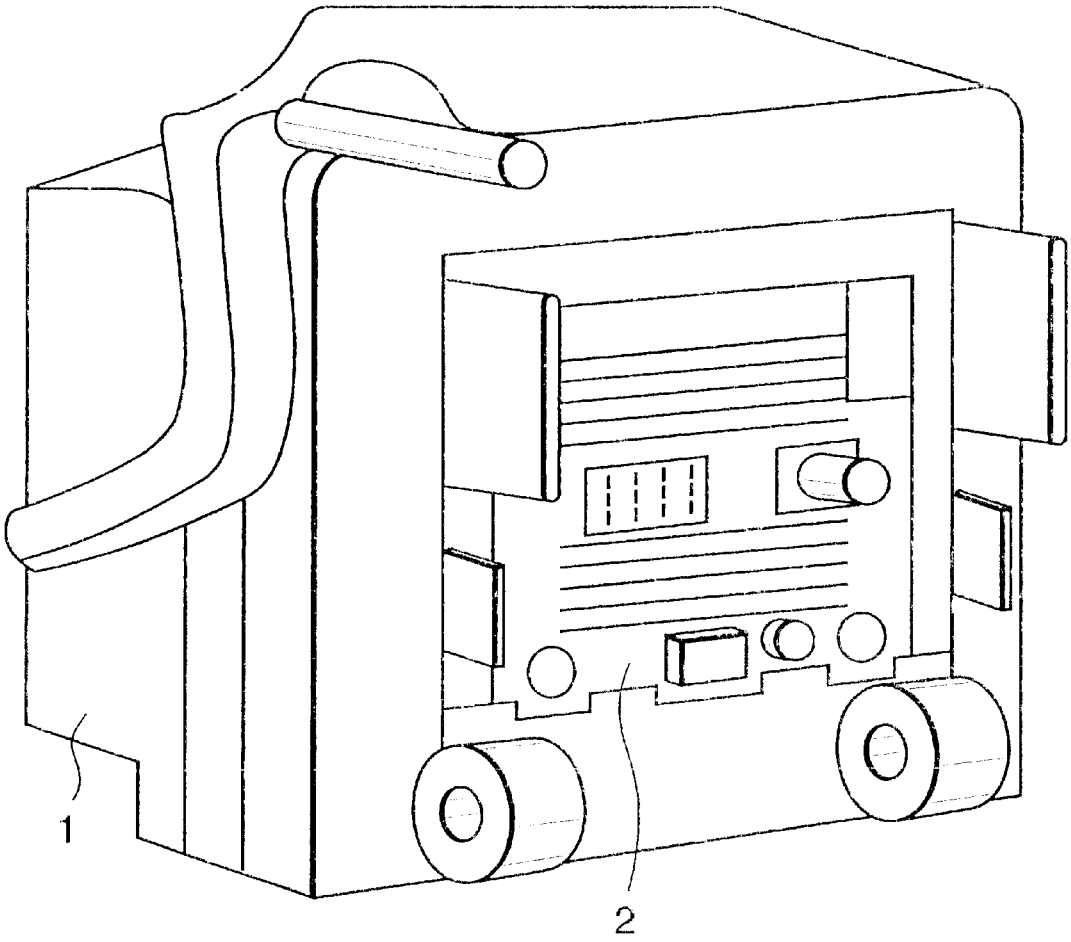
FIG. 1 is an external view showing a construction of a carriage unit of a printing apparatus according to an embodiment of the present invention.

FIG. 1 is an external view of a carriage unit 1 and a carriage print board unit 2, comprising a DC/DC converter, in an inkjet printer according to the present invention.

Figure 2:
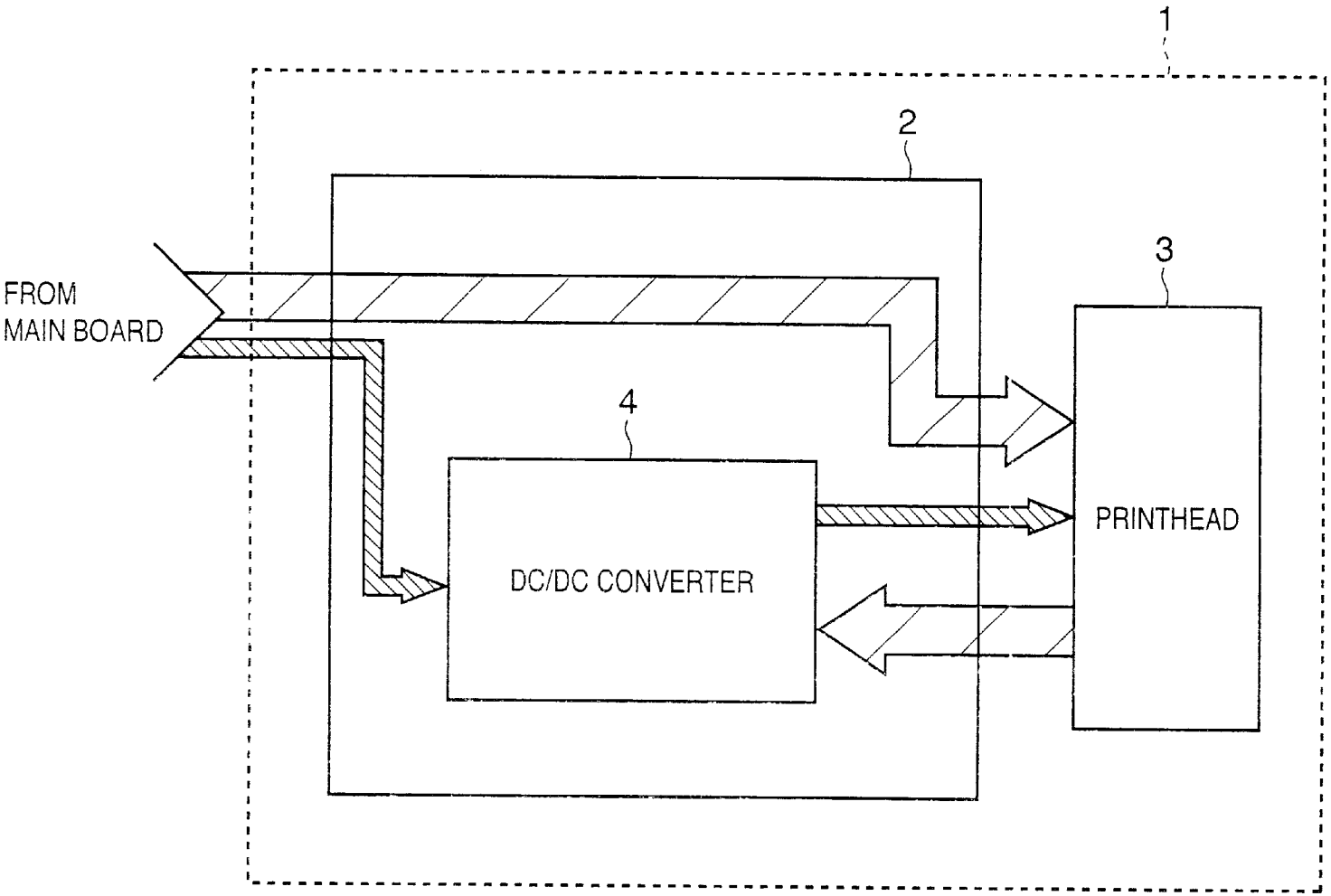
FIG. 2 is a view explaining a relation between the carriage print board unit 2 and printhead 3 of the printing apparatus according to the embodiment of the present invention.

FIG. 2 shows signal flows in the aforementioned carriage print board unit 2 and printhead 3 (or a device substrate constituting the printhead). In FIG. 2, print control signals are transmitted from a main board (not shown) of the printer main body, and print data signals are supplied to the printhead 3 through the carriage print board unit 2. Further, from a power source of the main board, a DC voltage power is supplied to the DC/DC converter 4 mounted to the carriage print board unit 2. The DC/DC converter 4 converts a voltage, necessary as a power source for driving the printhead 3, and supplies the DC voltage to the printhead 3.

A voltage value converted and outputted by the DC/DC converter is variable in accordance with an information signal from the printhead 3, e.g., an identification signal of the printhead, information indicative of a variation of heater resistances, head temperature data and so forth. This configuration enables adjustment of a power source voltage for optimizing the amount of power supplied to the heater resistances in accordance with a state of printhead, so as to enable always stable ink discharge in a case of mounting any type of printhead.

In this configuration, the amount of power W supplied to the heater resistances is calculated by equation (1).

$$W^2 = \frac{V^2}{R} \cdot T \tag{1}$$

V indicates an applied voltage; R, a heater resistance value; and T, a pulsewidth. By making the voltage variable, a pulsewidth of a head driving pulse can be controlled constant at all times.

Furthermore, by mounting the DC/DC converter to the carriage print board unit 2, the problem of a voltage drop, caused by an impedance of a long flexible board connecting the main board to the carriage board or an impedance of distribution lines such as connectors or the like inserted in the board, is solved. Therefore, it is possible to decrease the number of power source lines.

Circuit Structure and Operation of Circuit

Figure 3:
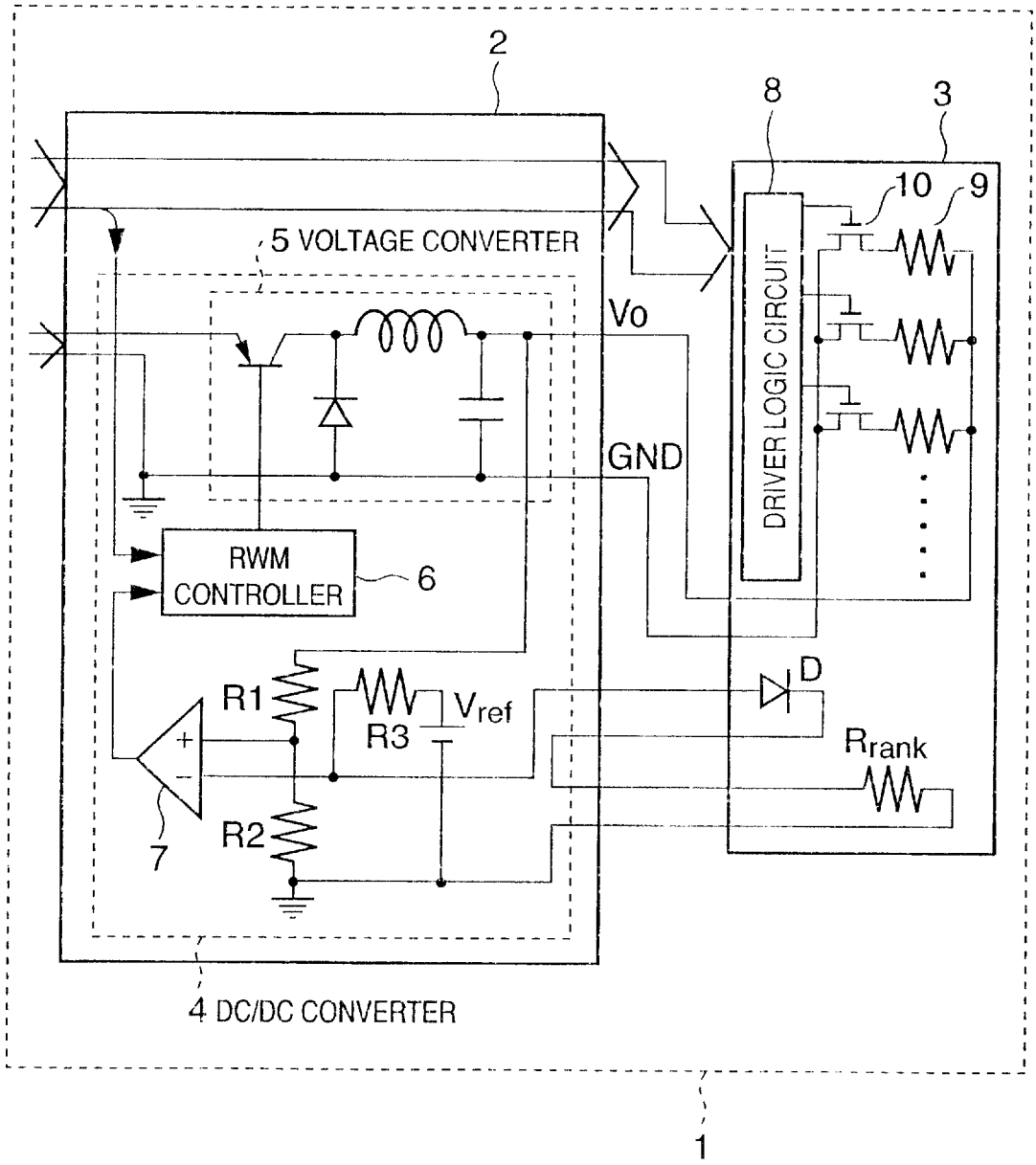
FIG. 3 is a view explaining contents of voltage control executed by the carriage print board unit 2 of the printing apparatus according to the embodiment of the present invention.

Next, a circuit structure and operation of the DC/DC converter mounted to the carriage print board unit 2 are described with reference to FIG. 3. In FIG. 3, reference numeral 2 denotes a carriage board; and 3, a printhead.

Reference numeral 4 denotes a DC/DC converter; 5, a voltage converter of the DC/DC converter; 6, a PWM controller which drives a main switch element of the DC/DC converter; and 7, an error amplifier which compares an output voltage with a reference voltage. R1, R2 and R3 denote high-precision resistances for voltage detection and reference voltage division; and $V_{ref}$ denotes a reference voltage for setting an output voltage of the DC/DC converter.

Reference numeral 8 denotes a driver logic circuit which generates a control signal for driving each heater of the printhead; 9, a heater resistance driven by the control signal generated by the driver logic circuit 8; and 10, a switch device for switching ON/OFF of the heater resistance 9. $R_{rank}$ denotes a detection resistance provided in the printhead for detecting a variation of the heater resistances 9 in each printhead. The reference letter "D" of the printhead 3 in FIG. 3 denotes a diode provided in the printhead for detecting a printhead temperature.

An output voltage $V_o$ of the DC/DC converter 4 adjusts timing of switching ON/OFF of the switch devices so as to keep an equal voltage value at the uninverting terminal and inverting terminal of the error amplifier 7. Therefore, the output voltage is determined by a resistance ratio of the resistances R1 and R2 which divide the output voltage $V_o$, and a voltage division ratio of the resistance R3 which divides the reference voltage $V_{ref}$, detection resistance $R_{rank}$ provided in the printhead, and diode D provided for temperature detection.

Herein, the detection resistance $R_{rank}$ is manufactured in the printhead substrate 3, including the heater resistances 9, by the same semiconductor deposition process as that of the heater resistances 9 provided as printing elements for performing printing. A variation of the detection resistance $R_{rank}$ falls within a range that is relatively in line with a variation of resistance values of the heater resistances 9.

Therefore, when the heater resistance value R in equation (1) varies to a plus (increase) from a set value, the value of the detection resistance $R_{rank}$ increases for the amount of variation. Since a voltage inputted to the inverting terminal of the error amplifier 7 in the DC/DC converter 4 is a value in which the reference voltage $V_{ref}$ is divided by a resistance R3 and detection resistance $R_{rank}$, the voltage inputted to the inverting terminal of the error amplifier 7 increases as the $R_{rank}$ increases by the variation, and as a result, the output voltage $V_o$ increases. By virtue of the above-described operation, even if the resistance values of the heater resistances 9 vary, the amount of power supplied to the heater, which is determined by equation (1), can be maintained virtually stable without changing a time width of the driving pulse.

Also, in a case of changing a head driving voltage in accordance with the type of printhead, e.g., a printhead for black ink or color ink, a virtually stable amount of power can be supplied to the heater by the above-described operation in the above-described circuit structure. In this case, a value of the detection resistance $R_{rank}$ is set such that the output voltage $V_o$ of the DC/DC converter 4 becomes a desired voltage value.

Controlling Printhead Temperature

Next, a description is provided on the operation performed in a case where a temperature of the printhead 3 increases. The diode D is used for detecting a printhead temperature. When the temperature of the printhead 3 increases, a small amount of power is required for discharging ink. If the same amount of power as that in a case of a normal temperature is supplied, a larger amount of ink droplets is discharged, which may change the print density. Even if a change in the size of an ink droplet cannot be perceived visually, supplying an excessive amount of power causes to further increase the printhead temperature. Therefore, it is necessary to control the amount of power in accordance with a temperature increase of the printhead.

Operation for controlling the amount of power in accordance with a temperature increase of the printhead 3 is now described. A forward voltage VF of the temperature detection diode D, provided in the printhead 3, has a negative temperature coefficient. Therefore, the forward voltage VF decreases as the temperature in the printhead 3 increases. Since a voltage inputted to the inverting terminal of the error amplifier 7 in the DC/DC converter 4 is a value in which the reference voltage $V_{ref}$ is divided by the resistance R3, diode D, and detection resistance $R_{rank}$ of the printhead 3, the voltage inputted to the inverting terminal decreases as the forward voltage VF of the diode D decreases, and as a result, the output voltage $V_o$ decreases. By virtue of this operation, the amount of power supplied to the heater, which is determined by equation (1), can be reduced.

Load Current Variation in Printing

Figure 4:
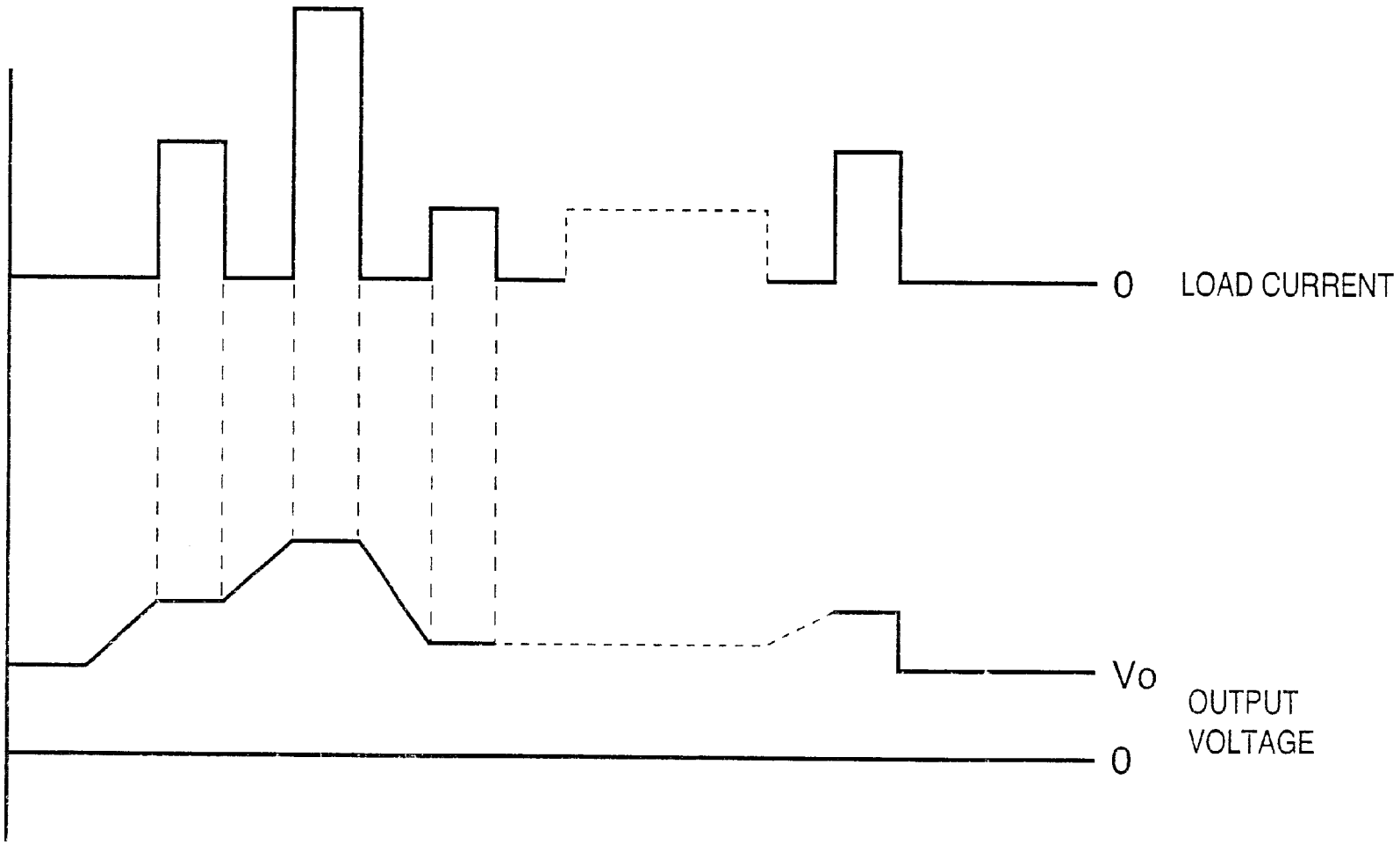
FIG. 4 shows waveforms of a current and voltage for explaining an effect of voltage control according to the embodiment of the present invention.

Next, a description is provided on varying an output voltage of the DC/DC converter 4 in accordance with a load current variation at the time of printing. A load current of a printhead is determined by the number of simultaneously driven nozzles selected from a large number of ink discharge nozzles formed in the printhead. The number of simultaneously driven nozzles changes in accordance with a print data signal and print control signal, transmitted from the main board. Waveforms of a load current and output voltage are shown in FIG. 4. The DC/DC converter 4 supplies a constant voltage to the heater resistances 9 in the printhead 3. However, when the printhead 3 has a large number of nozzles, the printhead includes many wirings, causing an increased wiring resistance value for each wiring.

Therefore, even if a constant voltage is outputted by the DC/DC converter 4, a voltage drop is caused on the end of the heater resistances 9 due to a load current in the wirings, and a decreased amount of power is actually supplied to the heaters. In order to solve this problem, the first embodiment is constructed such that a signal, which determines the number of nozzles driven simultaneously, is supplied to the PWM controller 6 of the DC/DC converter 4 based on the print control signal, sent from the main board to the printhead, so as to correct ON/OFF timing of the DC/DC converter 4, thereby instantaneously changing the output voltage $V_o$. This realizes the variation of the output voltage shown in FIG. 4. More specifically, the output voltage $V_o$ is increased when a large number of ink discharge nozzles is driven simultaneously and the load current is large. By virtue of this, a constant voltage is supplied to the heater resistances even if a voltage drop is caused by wiring resistances in the printhead.

Controlling a pulsewidth by the PWM Controller 6 enables controlling of the output voltage $V_o$ of the DC/DC converter 4. In this case, the amount of power determined by equation (1) is controlled by the voltage and pulsewidth.

Second Embodiment

Figure 5:
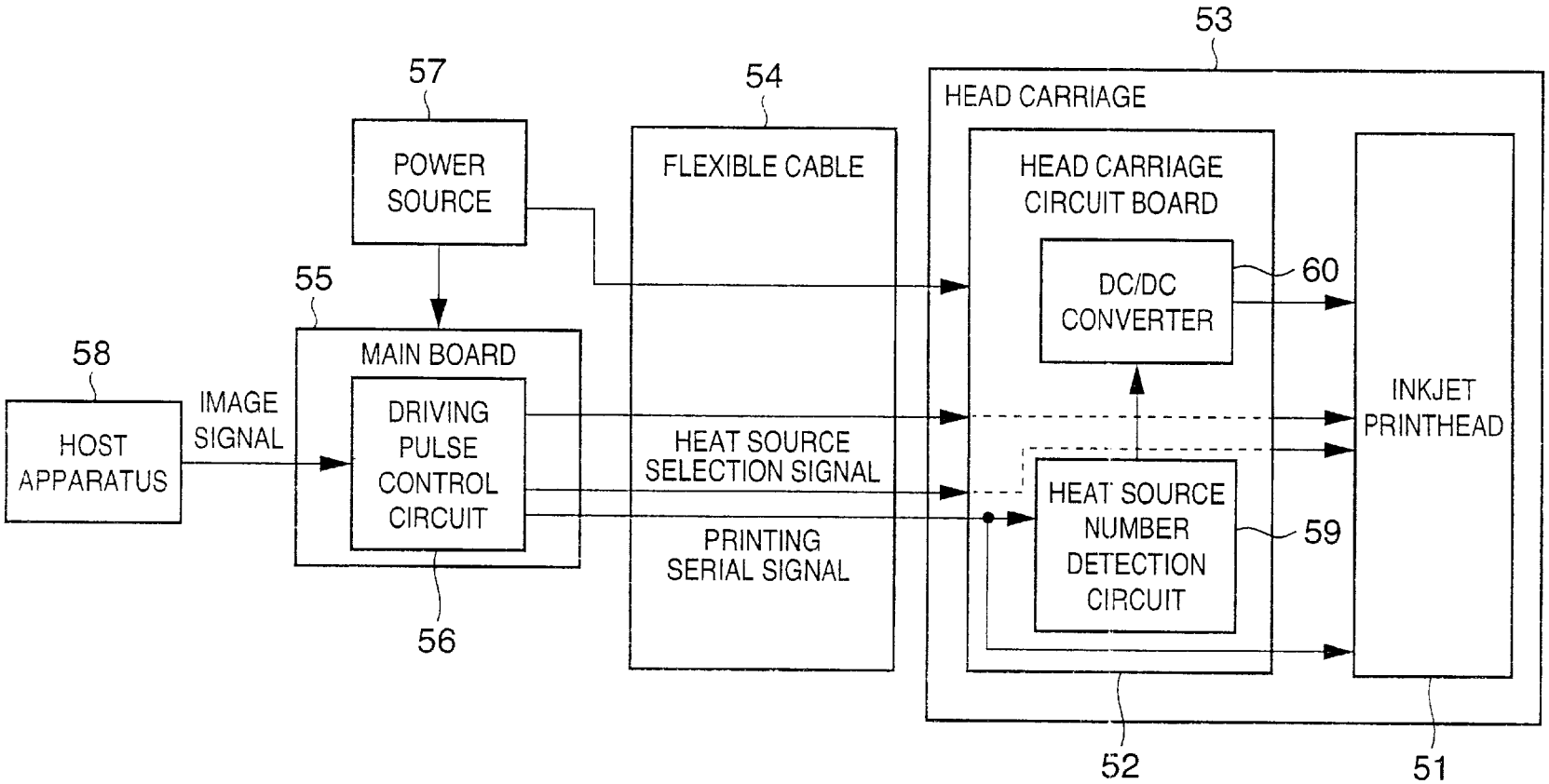
FIG. 5 is a block diagram showing a brief construction of a printing apparatus according to a second embodiment of the present invention.

Hereinafter, an inkjet printing apparatus according to the present invention is described with reference to the drawings. FIG. 5 is a block diagram showing a brief construction of a printing apparatus according to the second embodiment of the invention.

Figure 7:
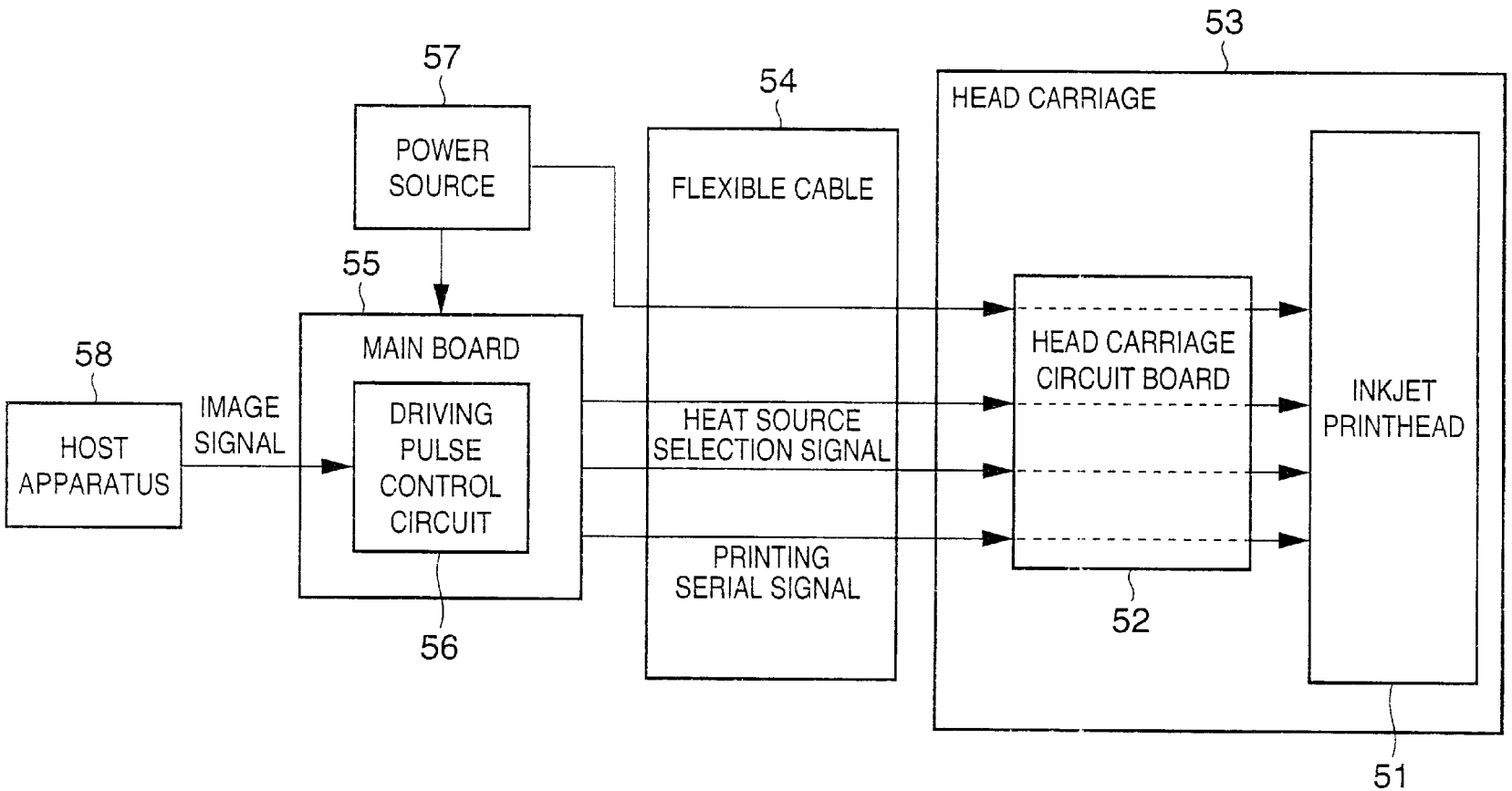
FIG. 7 is a block diagram showing a brief construction of a conventional inkjet printer.

Note in FIG. 5, the components identical to or corresponding to that of the conventional example shown in FIG. 7 are referred to by the same reference numerals. The following description is provided on the main points of the difference between this embodiment and the conventional example. In FIG. 5, reference numeral 59 denotes a heat source number detection circuit; and 60, a DC/DC converter.

Figure 6:
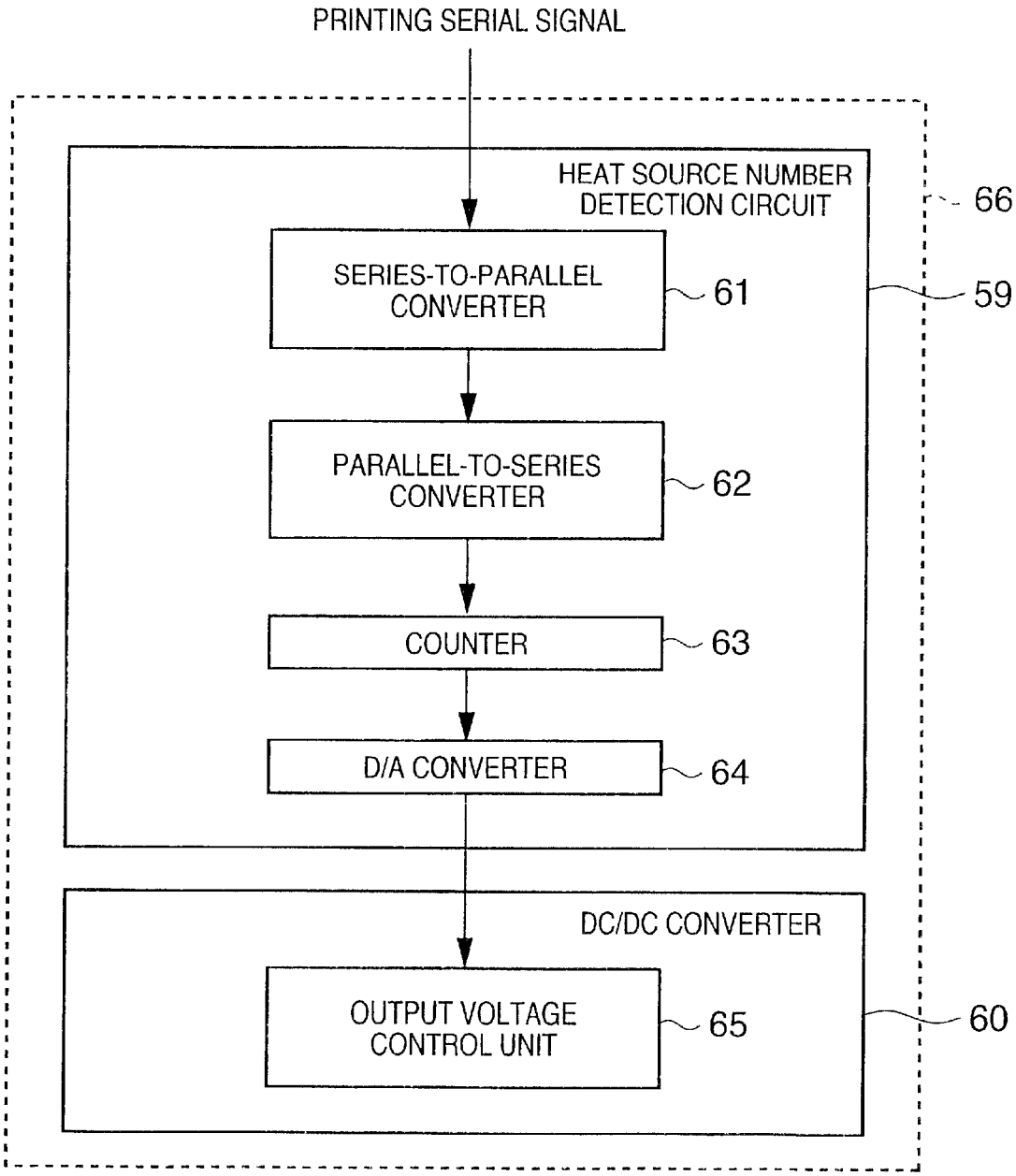
FIG. 6 is a diagram showing a brief construction of a head carriage circuit board.

FIG. 6 is a diagram showing a brief construction of the head carriage circuit board 52 shown in FIG. 5. Referring to FIG. 6, reference numeral 61 denotes a series-to-parallel converter; 62, a parallel-to-series converter; 63, a counter; 64, a D/A converter; and 65, output voltage control unit.

Figure 8:
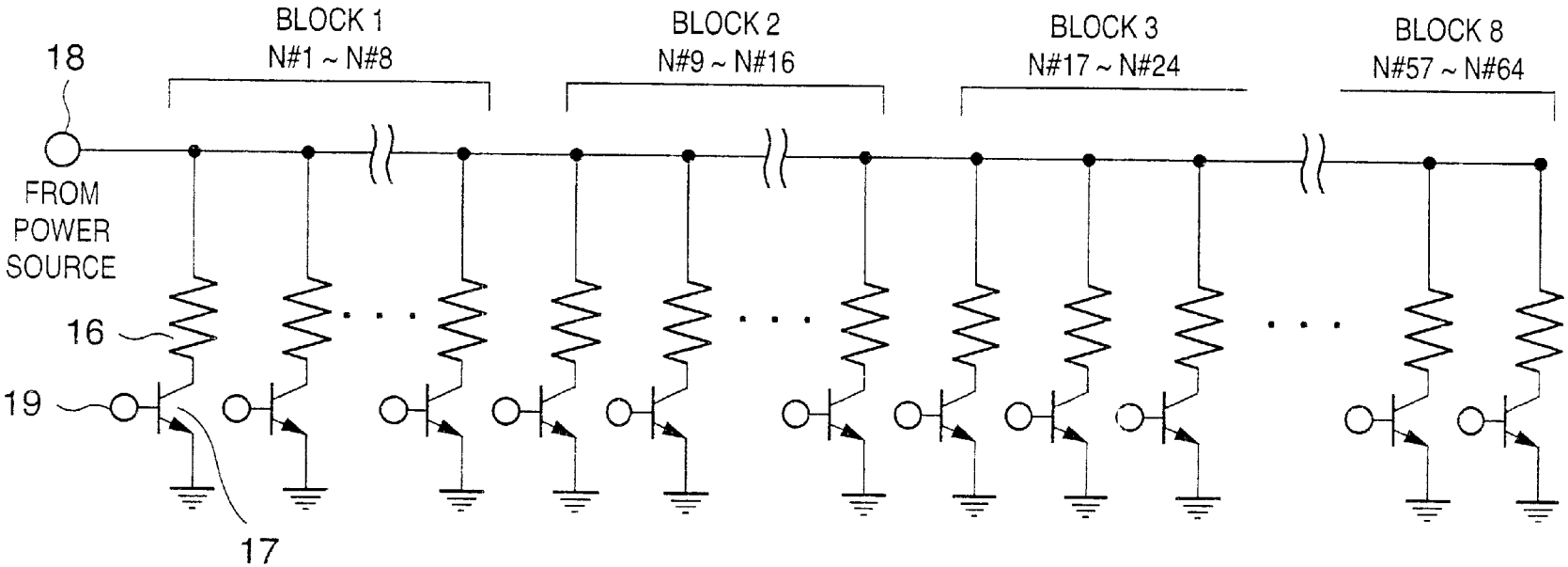
FIG. 8 is an explanatory view of connection between heating resistances and driving switches in a conventional inkjet printhead shown as an example.

Note that the inkjet printhead 51 has the same construction as that described with reference to FIG. 8, which shows an explanatory view of connections between the heating resistances 16 (heater resistances) and driving switches in a conventional inkjet printhead.

A printing serial signal, outputted from the driving pulse control circuit 56 of the main board 55, is received by the serial-to-parallel converter 61 of the heat source number detection circuit 59. The serial-to-parallel converter 61 converts the printing serial signal to a parallel signal. The converted parallel signal is provided as a driving signal corresponding to 64 nozzles, divided into 8 blocks each having 8 nozzles. The parallel signal is inputted in block unit to the parallel-to-serial converter 62.

Herein, the driving signal for the 64 nozzles, each having a heater resistance for discharging ink, is divided into block units. The counter 63 counts the number of simultaneously driven nozzles (the number of heater resistances) in one block by utilizing data or signals which control the driving. There are 8 counters to count the number of nozzles in each block. The number of nozzles driven simultaneously, counted by the counter 63, is outputted as a digital signal. The digital signal is converted to an analog signal by the D/A converter 64. The analog signal is inputted to the output voltage control unit 65 of the DC/DC converter 60 in synchronization with the driving pulse for each block. The DC/DC converter 60 is controlled to change the output voltage in accordance with the number of simultaneously driven nozzles.

The power source 57 in FIG. 5 serves as a switching regulator which controls an inputted AC voltage by using switching means or the like to output a DC voltage. The power source 57 outputs at least two types of voltages: 5V used as a power source voltage of a logic circuit, such as the main board 55 or the like, and 30V used as a power source of the DC/DC converter 60 mounted to the head carriage 53.

Herein, the output voltage 30V requires as much precision as that required by a motor. The output voltage, in which high precision is not required, is supplied from the power source 57 to the head carriage 53 through the flexible cable 54 in the inkjet printing apparatus. The DC/DC converter 60, mounted to the head carriage circuit board 52 of the head carriage 53, receives the output voltage 30V and outputs a voltage by a switching unit or the like. The DC/DC converter 60 outputs a high-precision voltage required by the inkjet printhead.

Note, when there are plural inkjet printheads 51 requiring different power source voltages, a DC/DC converter having multiple outputs may be employed. Further, in a case where the number of nozzles discharging ink is different for each of the plural inkjet printheads 51, the objects of the present invention can be attained by providing the heat source number detection circuit 59 and DC/DC converter 60 to each of the plural inkjet printheads.

The heat source number detection circuit 59 detects the number of heat sources (heater resistances) driven simultaneously based on the printing serial signal. In accordance with the detected result, the DC/DC converter 60 controls an output voltage of the power source. The output voltage is controlled so as to apply a steady amount of power to the inkjet printhead 51. Accordingly, ink discharged from each nozzle of the inkjet printhead 51 is uniformly stabilized. Moreover, in the heat source control, since a DC voltage, which is not a function of time, is controlled instead of controlling a pulsewidth which is a function of time, it is possible to increase the speed of the ink discharge control and inkjet printing apparatus.

Furthermore, by virtue of providing the DC/DC converter 60 to the head carriage 53, it is possible to supply a steady amount of power regardless of whether or not a large/small number of nozzles are driven simultaneously.

Moreover, with respect to the power source, a DC/DC converter is provided to the head carriage in addition to the conventional multiple-output AC/DC converter. By virtue of this, for instance, a precision of only about ±5% is required for an output voltage of the AC/DC converter. Accordingly, the AC/DC converter achieves an increased flexibility in its design, and cost reduction.

Furthermore, by designing the DC/DC converter, which is mounted to the head carriage, for each product's specification, a specification of the AC/DC converter can be kept unchanged. Therefore, the AC/DC converter can be used for other products, realizing recycling (reuse) of the AC/DC converter. Furthermore, an increased number of productions contributes to cost reduction.

Third Embodiment

Figure 12:
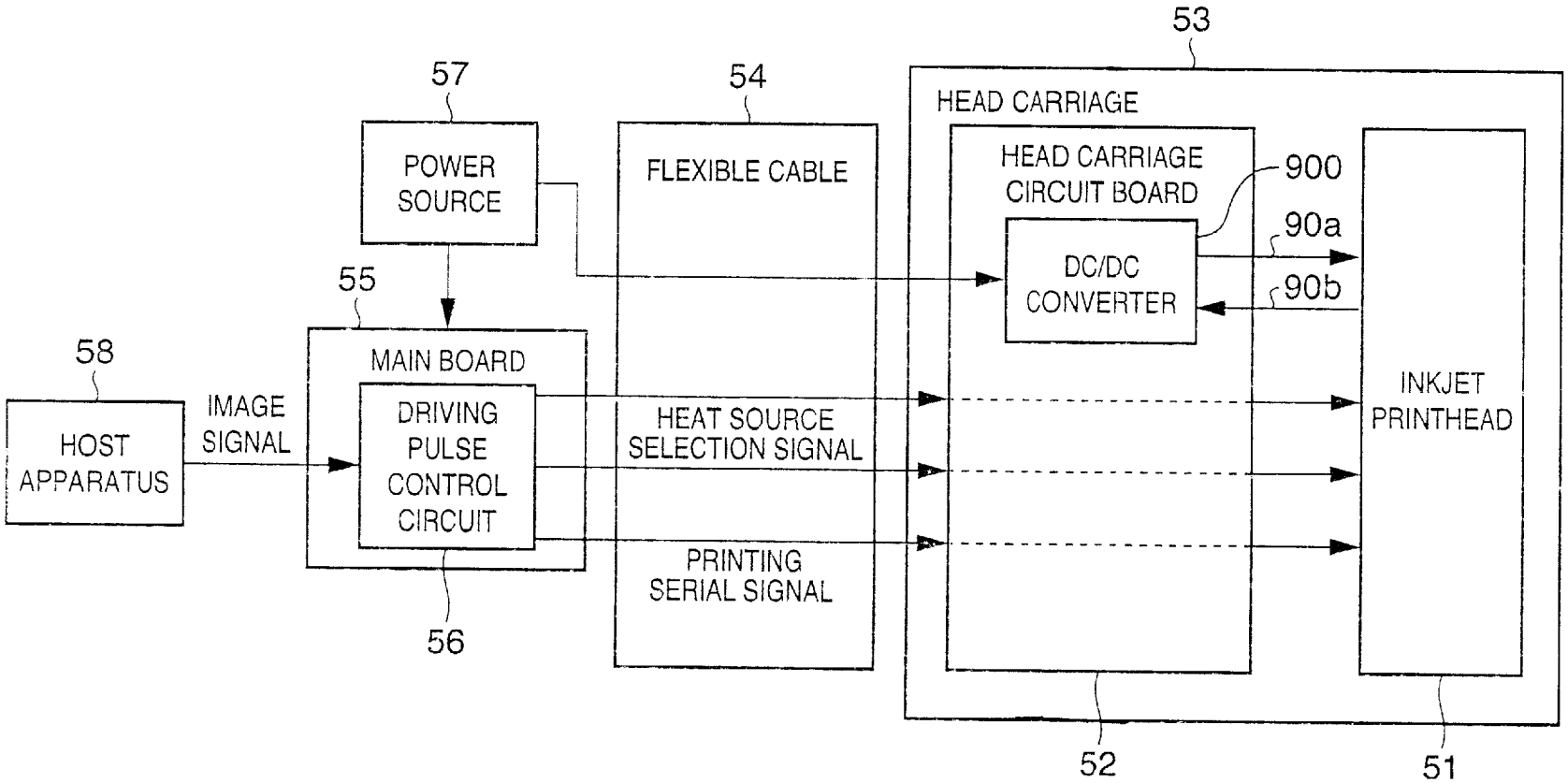
FIG. 12 is a block diagram showing a brief construction of an inkjet printing apparatus according to a third embodiment of the present invention.

FIG. 12 is a block diagram showing a brief construction of an inkjet printing apparatus according to the third embodiment. Note in FIG. 12, the components identical to or corresponding to that of the conventional example shown in FIG. 7 are referred to by the same reference numerals. The following description is provided mainly on the difference between this embodiment and the conventional example.

In FIG. 12, a DC/DC converter 900 is provided to the head carriage circuit board 52. The DC/DC converter 900 receives a voltage from the power source 57 of the inkjet printing apparatus, and detects (90*b*) a variation of the heater resistances or the like in the inkjet printhead 51. Based on the voltage supplied by the power source 57 and variation of the heater resistances, the DC/DC converter 900 generates and outputs a driving voltage (90*a*) for controlling the inkjet printhead 51 to perform most appropriate ink droplet discharge.

Figure 13:
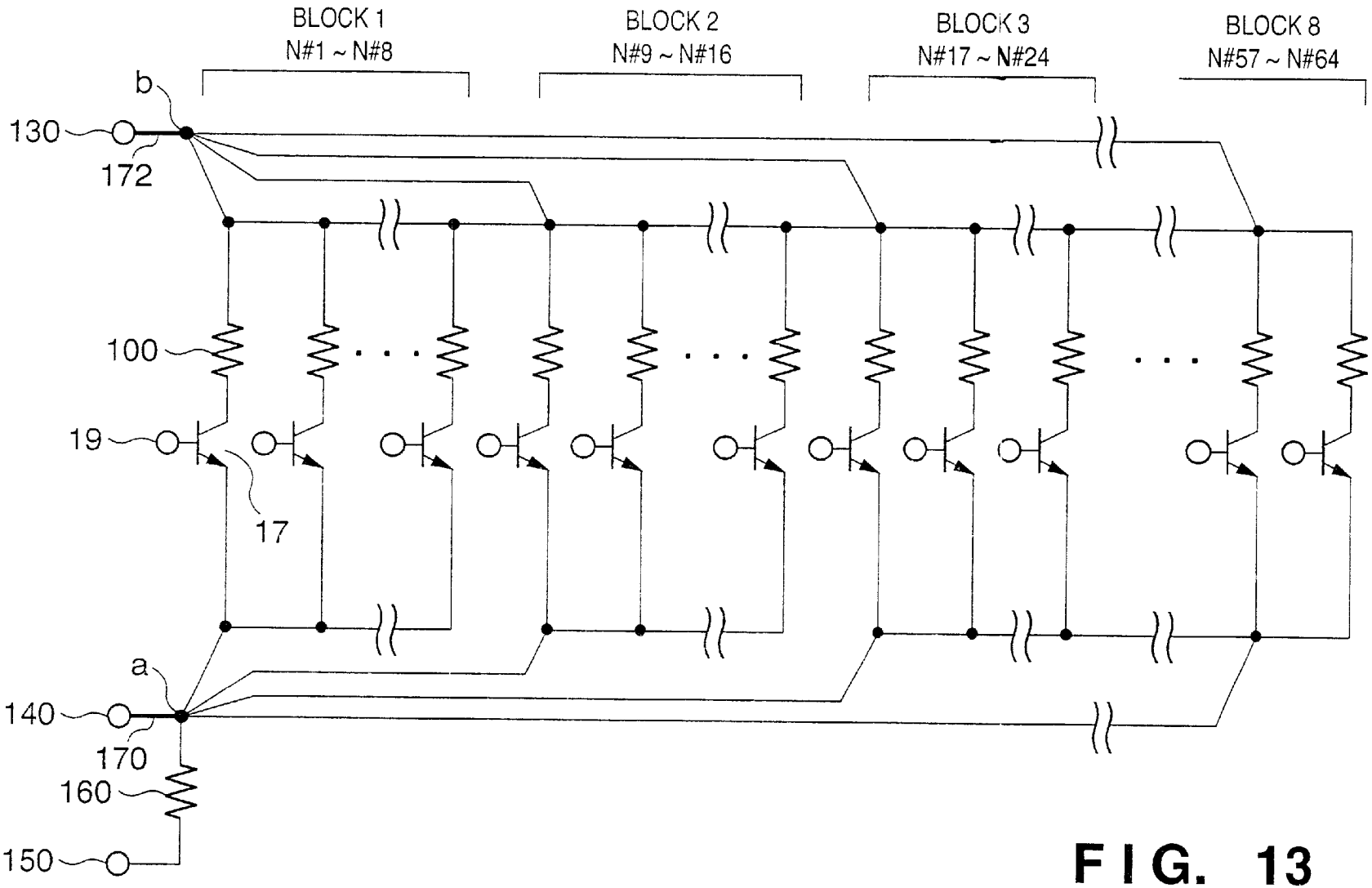
FIG. 13 is a circuit diagram of an inkjet printhead.

FIG. 13 is a circuit diagram of an inkjet printhead. In FIG. 13, reference numeral 130 denotes a power supply terminal; 140, a GND terminal; 150, a reference voltage side terminal; 160, a rank resistance; 170 and 172, common wirings (indicated by a thick line). This circuit is normally formed on a silicon substrate (chip) manufactured in a silicon process. A chip, on which the aforementioned heater resistances and circuit for printing are formed, is the device substrate. Wirings on the GND side are divided into blocks, and the wiring of each of these blocks connects to the GND at point a, thereby connecting to the GND side terminal 140.

Wirings on the power supplying side are also divided into blocks, and the wiring of each of these blocks meets at point b, thereby connecting to the power supply terminal 130 through the common wiring 172.

Figure 14:
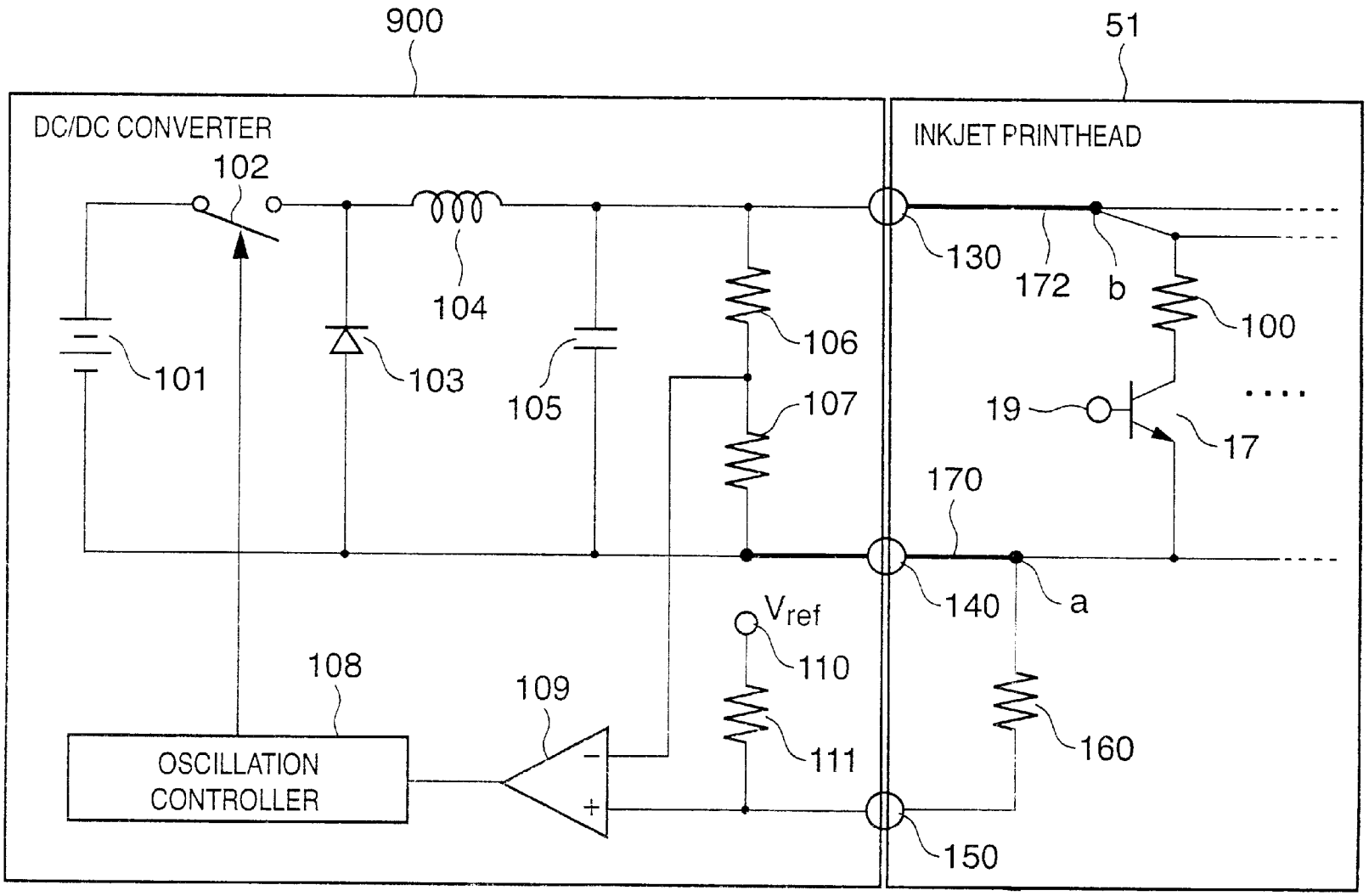
FIG. 14 is a circuit diagram showing connections between the inkjet printhead 51 and DC/DC converter 900.

FIG. 14 is a circuit diagram showing connections between the inkjet printhead 51 shown in FIG. 13 and DC/DC converter 900 shown in FIG. 12.

Referring to FIG. 14, reference numeral 101 denotes a DC power source; 102, a switching device; 103, a diode; 104, an inductor; 105, a condenser; 106 and 107, dividing resistances; 108, an oscillation controller; 109, an error amplifier; 110, a reference voltage input terminal; and 111, a reference voltage dividing resistance.

The inkjet printhead 51 is constructed with one or more removable head units. Since the head driving circuit (entire portion shown in FIG. 13) of the inkjet printhead 51 is normally formed on a silicon substrate (chip) manufactured in a silicon process, the heater resistances 100 (64 resistances: 8 heater resistances in each block×8 blocks) of the inkjet printhead 51 have substantially the same resistance value. The rank resistance 160 is also formed on the silicon substrate. A variation, generated in the process of manufacturing silicon substrates in one production lot, causes a variation in the inkjet printhead 51. Note that the inkjet printhead 51 includes the aforementioned device substrate and nozzles (discharge orifices and ink channels) corresponding to the heater resistances provided on the device substrate.

For instance, there may be a case that one inkjet printhead 51 is manufactured with a heater resistance 100 having a resistance value of 100 Ω and a rank resistance 160 having a resistance value of 1KΩ, while another inkjet printhead 51 is manufactured with different resistance values, a heater resistance 100 having a resistance value of 80 Ω and a rank resistance 160 having a resistance value of 800 Ω. In this example, the heater resistance 100 and rank resistance 160 vary at the same rate. Therefore, it can be said that the resistances of the latter printhead 51 are formed with −20% variation compared to the former printhead 51.

As explained above, there is a case that the heater resistances 100 and rank resistance 160 of the inkjet printhead 51 are manufactured with variations. Since the inkjet printhead 51 has a removable configuration in an inkjet printing apparatus, there are variations of resistance values inherent to the printhead mounted to the inkjet printing apparatus. In order to achieve stable ink droplet discharge, it is necessary to correct and generate a driving voltage for each inkjet printhead mounted, and control the inkjet printhead 51 having the variation. In the aforementioned example, it is necessary to control the driving voltage of the printhead so as to compensate the −20% variation.

In order to correct the variation, it is necessary to detect a resistance value of the heater resistances 100 of the inkjet printhead 51. The rank resistance 160 (FIGS. 13 and 14) is provided in the printhead 51 as detection means for having the inkjet printing apparatus perform detection. Based on a resistance value of the rank resistance 160, the resistance value of the heater resistances 100 can be detected.

The rank resistance 160 is provided between the reference voltage side terminal 150, provided for transmitting information to the inkjet printing apparatus, and GND side terminal 140 as shown in FIGS. 13 and 14.

A current transmitted to the heater resistances 100, selected in accordance with the heat source selection signal and printing serial signal sent from the main board 55, is transmitted to the common wiring 170. The common wiring 170 has a wiring resistance, e.g., 1 Ω. Note that the wiring resistance of the common wiring 170 is the sum of the wiring resistance in the internal portion of the printhead formed on the silicon substrate, a contact resistance generated with an external substrate, and a wiring resistance of the external substrate. A brief value of the resistance value can be determined as a designed value based on the thickness, width, and length of the wiring pattern. The heater resistances 100 are driven in block unit as described in the conventional example. Depending on the printing condition, a current is transmitted to 0 heater resistance 100 at the minimum and to 8 heater resistances 100 at the maximum. Assuming that a resistance value of the heater resistances is 100 Ω and a voltage at the power supply terminal 130 is 20V, 0.2A is transmitted per each heater resistance 100.

Therefore, in the common wiring 170, a voltage drop ranging from 0V (driving 0 heater resistance) to 1.6V (driving 8 heater resistances) is caused depending on the wiring resistance. Since the GND terminal is 0V, the voltage at point a varies from 0V to 1.6V.

Figure 17:
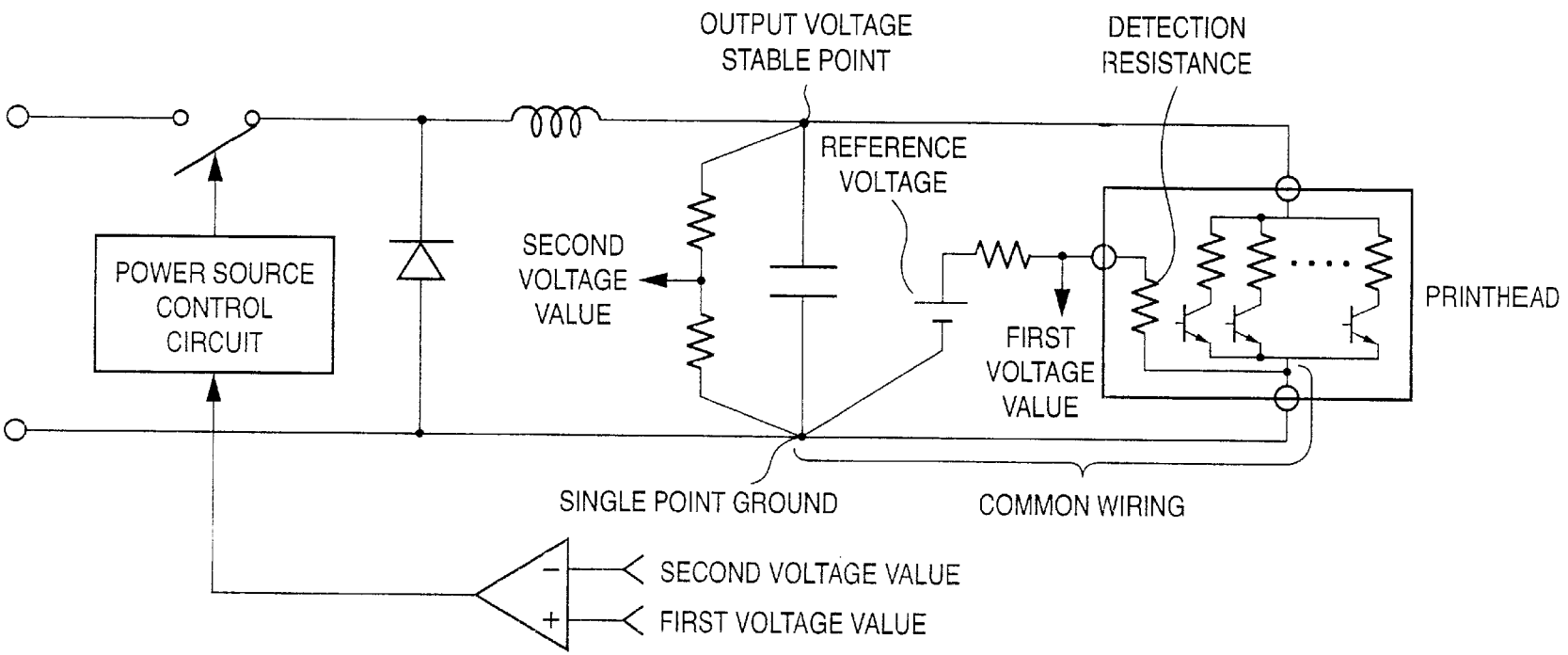
FIG. 17 is an explanatory view of a common wiring.

Hereinafter, the aforementioned common wiring is described with reference to FIG. 17. Provided that a GND side terminal of an output voltage smoothing condenser of a power source is a single point ground, the common wiring is a wiring portion, where the GND wiring transmitting a load current from the single point ground and the GND wiring connected to the GND side terminal of the detection resistance are not branched off, and where the common currents are mutually transmitted.

The DC/DC converter 900 is a step-down-type DC/DC converter. In order to most appropriately discharge an ink droplet regardless of a variation of each inkjet printhead 51 mounted, a voltage of the reference voltage input terminal 110 is divided by the rank resistance 160 and reference voltage dividing resistance 111, and the divided voltage is inputted to the error amplifier 109 as a plus terminal voltage. The voltage inputted to the plus terminal is compared with a voltage divided by the dividing resistances 106 and 107, and inputted to the error amplifier 109 as a minus terminal voltage. The comparison result is outputted to the oscillation controller 108.

The oscillation controller 108 controls the switching device 102 in accordance with the comparison result of the error amplifier 109, and outputs a voltage most appropriate for the inkjet printhead 51 to the power supply terminal 130.

In other words, the DC/DC converter 900 is constructed such that the output voltage is variable in accordance with the rank resistance 160. Accordingly, a steady amount of power can be supplied to the heater resistance 100 without controlling a pulsewidth, even when the pulsewidth is fixed. Therefore, it is possible to supply the inkjet printhead with a constant voltage for discharging a steady amount of ink droplets.

A voltage at point a varies based on the number of heater resistances 100 driven simultaneously and the wiring resistance of the common wiring 170. When the number of simultaneously driven heater resistances 100 is large, the voltage at point a increases due to the wiring resistance of the common wiring 170. The plus terminal voltage of the error amplifier 109, determined by the reference voltage dividing resistance 111 and rank resistance 160, which divide the voltage of the reference voltage input terminal 110, increases. Along with this increase, the minus terminal voltage of the error amplifier 109 is controlled to rise. Since the minus terminal voltage is determined by the dividing resistances 106 and 107 of the output voltage, the oscillation controller 108 operates to increase the output voltage.

A voltage drop due to the wiring resistance takes place not only in the common wiring portion (on the GND wiring side) as described above, but also in the power source side wirings. Therefore, a voltage applied to the heating resistances (heater resistances) of the printhead is a value, in which the voltage drop due to wiring resistances on the power source side and the GND side is subtracted from the output voltage of the DC/DC converter 900.

In view of this, the connection position of the GND side terminal of the rank resistance 160 is determined so as to cancel the voltage drop by appropriately setting the wiring resistance in the common wiring portion. The following description is provided with reference to the equivalent circuit diagram in FIG. 15.

Figure 15:
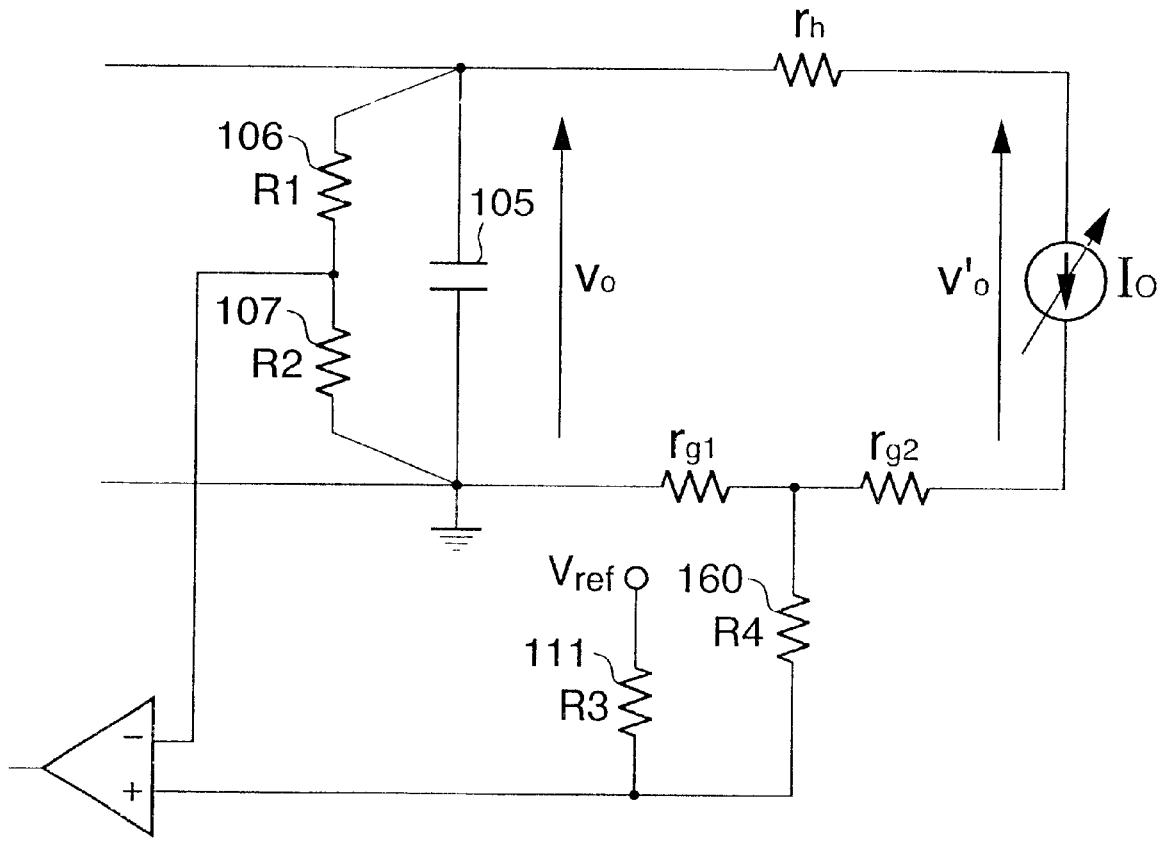
FIG. 15 is an equivalent circuit diagram for explaining a connection position of a GND side terminal of the rank resistance 160.

Referring to FIG. 15, a wiring resistance on the power source side is $r_h$, a resistance in the common wiring portion is $r_{g1}$ and a resistance in the uncommon wiring portion is $r_{g2}$ on the GND side. A load current is $I_0$, which varies in accordance with the number of nozzles driven simultaneously. An output voltage of the DC/DC converter 900 is $V_0$, and a voltage applied to the heater resistances of the printhead is $V'_0$.

A plus terminal voltage $V_+$ of the error amplifier can be expressed by the following equation:

$$V_+ = (V_{ref} - V_l) \times \frac{R_4}{R_3 + R_4} + V_l = V_{ref} \times \frac{R_4}{R_3 + R_4} + V_l\left(1 - \frac{R_4}{R_3 + R_4}\right) \quad (2)$$

Note that $V_1$ is a voltage drop of the common wiring 170, expressed by $V_1 = r_{g1} \times I_0$. Therefore, $$V_+ = V_{ref} \times \frac{R_4}{R_3 + R_4} + r_{gl} I_0 \times \frac{R_3}{R_3 + R_4} \quad (3)$$

The output voltage $V_0$ of the DC/DC converter 900 is expressed as follows:

$$V_0 = V_- \times \frac{R_1 + R_2}{R_2} \approx V_+ \times \frac{R_1 + R_2}{R_2} \quad (4)$$

Therefore, the voltage $V'_0$ applied to the heater resistances is expressed as follows:

$$\begin{aligned} V'_0 &= V_0 - (r_h + r_{gl} + r_{g2}) I_0 \\ &= \frac{R_1 + R_2}{R_2}\left\{V_{ref} \times \frac{R_4}{R_3 + R_4} + r_{gl} I_0 \frac{R_3}{R_3 + R_4}\right\} - (r_h + r_{gl} + r_{g2}) I_0 \\ &= V_{ref} \times \frac{R_4}{R_3 + R_4} \times \frac{R_1 + R_2}{R_2} + \left\{\left(\frac{R_1 + R_2}{R_2} \times \frac{R_3}{R_3 + R_4} - 1\right) r_{gl} - r_h - r_{g2}\right\} I_0 \end{aligned} \quad (5)$$

Herein, in order to achieve a constant voltage value regardless of the load current, the following equation must be satisfied.

$$\left(\frac{R_1 + R_2}{R_2} \times \frac{R_3}{R_3 + R_4} - 1\right) r_{gl} - r_h - r_{g2} = 0 \quad (6)$$

In other words, equation (7) must be satisfied.

$$r_{gl} = \frac{r_h + r_{g2}}{\frac{R_1 + R_2}{R_2} \times \frac{R_3}{R_3 + R_4} - 1} \quad (7)$$

Herein, assuming that $r_h = r_{g1} + r_{g2}$, i.e., the wiring resistance on the power source side is equal to the wiring resistance on the GND side, the connection position of the common wiring is determined so as to satisfy equation (8):

$$r_{gl} = \frac{2r_h}{\frac{R_1 + R_2}{R_2} \times \frac{R_3}{R_3 + R_4}} = \frac{2r_h}{\frac{V_0}{V_{ref}} - \frac{R_4}{R_3}} = \frac{V_{ref}}{V_0} \times \frac{R_3}{R_4} \times 2r_h \quad (8)$$

By determining the connection position of the common wiring in this manner, an influence of a voltage drop due to the wiring resistance is cancelled, and a constant voltage is applied to the heater resistances even when a load current varies.

An example is provided below, given that $V_0$=20V, $V_{ref}$=2.5V, $R_1$=15KΩ, $R_2$=1KΩ, $R_3$=$R_4$=1KΩ, and $r_h$=1 Ω:

$$r_{gl} = \frac{2.5}{20} \times \frac{1}{1} \times 2 = 0.25\Omega \quad (9)$$

Figure 16:
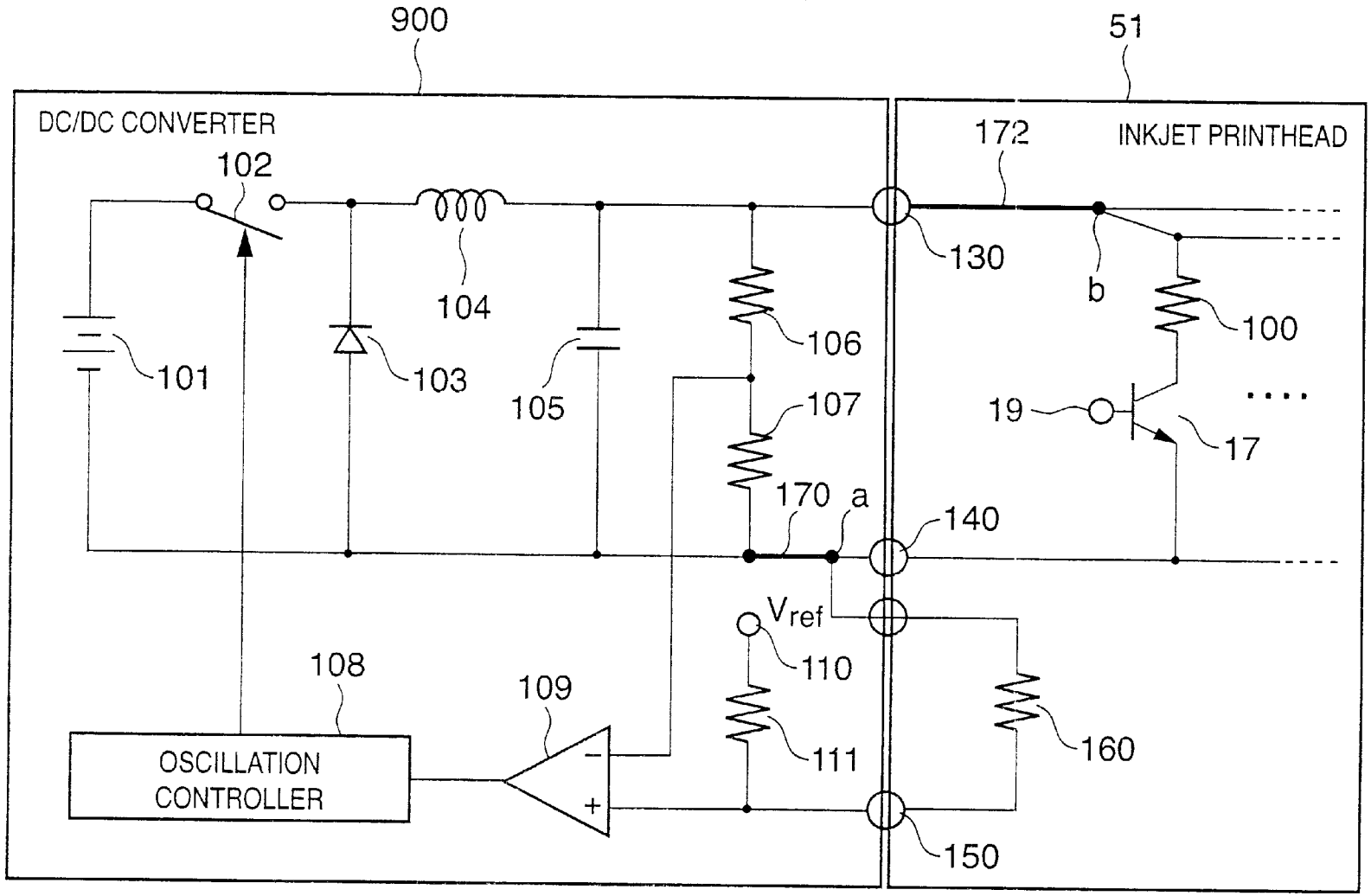
FIG. 16 is a circuit diagram showing connections between the inkjet printhead 51 and DC/DC converter 900.

In FIG. 14, the GND side terminal of the rank resistance 160 is connected to the GND line in the inner portion of the printhead 51. However, it may be connected outside the printhead 51 as shown in FIG. 16, i.e., in the middle point of the printhead 51 and DC/DC converter 900.

In response to the driving voltage applied by the power supply terminal 130, a resistance characteristic of the heater resistance 100 can be detected based on the wiring resistance of the common wiring 170 and the rank resistance 160 provided in the inkjet printhead. Furthermore, a resistance characteristics of the heater resistances, simultaneously driven in accordance with the heat source selection signal and so forth, can be detected as a variation of the amount of voltage drop caused in the circuit (connection point a of the common wiring) through the common wiring 170 and rank resistance 160. The common wiring 170 and rank resistance 160 serve as the detection means for detecting the number of simultaneously driven heater resistances 100.

The power source 57 serves as a switching regulator which controls an inputted AC voltage by using switching means or the like to output a DC voltage. The power source 57 has two types of output voltages: 5V used as a power source voltage of a logic circuit, such as the main board 55 or the like, and 30V used as a power source of the motor 1710 and the DC/DC converter 900 mounted to the head carriage 53. The output voltage 30V requires as much precision as that required for driving a motor. For instance, 30V±1.5V is acceptable as a variation. Among the voltage outputted by the power source 57, the output voltage 30V whose precision is not so much required is supplied to the head carriage 53 through the flexible cable 54 without going through the main board 55 in the inkjet printing apparatus.

The DC/DC converter 900, mounted to the head carriage circuit board 52 of the head carriage 53, is driven upon receiving the output voltage 30V. The DC/DC converter 900 generates and outputs a high-precision voltage required by the inkjet printhead 51. For instance, in the voltage level, the precision of 20V±0.3V is required. By mounting the DC/DC converter 900 to the head carriage 53, it is possible to minimize the wiring distance (wiring resistance of the power supply line) from the driving voltage supplying portion to the inkjet printhead 51. Accordingly, a constant voltage can be supplied regardless of the number of heater resistances 100 driven simultaneously.

Note, when there are plural inkjet printheads 51 requiring different power source voltages, a DC/DC converter having multiple outputs may be employed. By this, a driving voltage can be outputted to each of the plural inkjet printheads.

Furthermore, in a case where the number of nozzles discharging ink is different for each of the plural inkjet printheads 51, the objects of the present invention can be attained by providing the rank resistance 160, common wiring 170, and DC/DC converter 900 to each of the plural inkjet printheads 51.

As described above, a variation of the heater resistances 100 and the number of heater resistances 100 driven simultaneously are detected from the rank resistance 160 and common wiring 170, and based on the detection result, an output voltage of the DC/DC converter 900 can be changed. By virtue of this configuration, a steady amount of power can be supplied to the heater resistances 100 without controlling a pulsewidth, and as a result, stable ink droplets can be discharged from each of the nozzles. Furthermore, since the controlling is performed in a voltage direction instead of time direction, it is possible to increase the speed of the inkjet printing apparatus.

Still further, by virtue of detecting the number of heater resistances 100 driven simultaneously with the common wiring, additional parts are not necessary. This is effective in the aspects of cost and size.

Note that in the foregoing embodiments, although the description has been provided based on the assumption that a droplet discharged by the printhead is ink and that the liquid contained in the ink tank is ink, the contents are not limited to ink. For instance, the ink tank may contain processing liquid or the like, which is discharged to a print medium in order to improve the fixation or water resistance of a printed image or to improve image quality.

Each of the embodiments described above comprises means (e.g., an electrothermal transducer, laser beam generator, and the like) for generating heat energy as energy utilized upon execution of ink discharge, and adopts the method which causes a change in state of ink by the heat energy, among the ink-jet printing method. According to this printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand and continuous types. Particularly, in the case of the on-demand type, the system is effective because, by applying at least one driving signal, which corresponds to printing information and causes a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions of the invention described in U.S. Pat. No. 4,313,124 which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region, is also included in the present invention. In addition, the present invention can be effectively applied to an arrangement based on Japanese Patent Application Laid-Open No. 59-123670, which discloses the arrangement using a slot common to a plurality of electrothermal transducers as a discharge portion of the electrothermal transducers, or Japanese Patent Application Laid-Open No. 59-138461, which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive ink from the apparatus main unit upon being mounted on the apparatus main unit, or a cartridge type printhead, which has been described in the foregoing embodiment, in which an ink tank is integrally arranged on the printhead itself, is applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independent of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ ink which is solid at room temperature or less, or ink which softens or liquefies at room temperature, or ink which liquefies upon application of a printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, ink which is solid in a non-use state and liquefies upon heating may be used. In any case, ink which liquefies upon application of heat energy according to a printing signal and is discharged in a liquid state, ink which begins to solidify when it reaches a printing medium, or the like, is applicable to the present invention.

In this case, ink may be situated opposite to electrothermal transducers while being held in a liquid or solid state in recess portions of a porous sheet or through-holes, as described in Japanese Patent Application Laid-Open No. 54-56847 or 60-71260. In the present invention, the above-mentioned film boiling system is most effective for the above-mentioned inks.

Other Embodiments

The present invention can be applied to a system constituted by a plurality of devices (e.g., host computer, interface, reader, printer) or to an apparatus comprising a single device (e.g., copying machine, facsimile machine).

Further, the object of the present invention can also be achieved by providing a storage medium (or recording medium), storing program codes of a software realizing the above-described functions of the embodiments, to a computer system or apparatus, reading the program codes, by a CPU or MPU of the computer system or apparatus, from the storage medium, then executing the program. In this case, the program codes read from the storage medium realize the functions according to the embodiments, and the storage medium storing the program codes constitutes the invention. Furthermore, besides aforesaid functions according to the above embodiments being realized by executing the program codes which are read by a computer, the present invention includes a case where an OS (operating system) or the like working on the computer performs a part of or the entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, a CPU or the like contained in the function expansion card or unit performs a part of or the entire processes in accordance with designations of the program codes and realizes functions of the above embodiments.

As has been described above, according to the inkjet printing apparatus of the present invention, the carriage print board unit comprising a DC/DC converter enables to supply a steady amount of power for stable ink discharge regardless of variation aspects, such as a temperature rise of a printhead.

Furthermore, even if a time width of a heater resistance driving pulse is fixed to cope with the aforementioned variation aspects, it is possible to control the output voltage with high precision. Therefore, even an inkjet printer having an extremely large amount of nozzles can achieve high-speed and high-quality printing.

According to the inkjet printing apparatus of the present invention, the heat source detection circuit detects the number of heat sources driven simultaneously based on a printing serial signal, and in accordance with the detection result, the DC/DC converter controls an output voltage of the power source. By controlling the output voltage, the power applied to the inkjet printhead is stabilized. As a result, ink discharged from each nozzle of the inkjet printhead can uniformly be stabilized.

As many apparently widely different embodiments of the present invention can be made without departing from the spirit and scope thereof, it is to be understood that the invention is not limited to the specific embodiments thereof except as defined in the claims.

What is claimed is:

1. A printing apparatus forming an image on a print medium by supplying an electric energy necessary for printing to a plurality of heating resistances of a printhead, said printhead comprising:

a switching device for controlling each of the plurality of heating resistances; and a detection resistance for detecting a property corresponding to a resistance property of the heating resistances;

said apparatus comprising:

a voltage variable circuit for adjusting a power source voltage, applied to the heating resistances, in accordance with the resistance value of the detection resistance so as to apply energy appropriate for printing; and a head driving power source circuit for comparing a first voltage value, generated by dividing a reference voltage by the detection resistance and a resistance provided outside the printhead, with a second voltage value, generated by dividing an output voltage of the head driving power source driving the printhead by a resistance, and controlling an output voltage so as to cancel a difference between the first voltage value and the second voltage value, wherein the GND-side end of the detection resistance provided inside the printhead is connected as a common wiring with a GND wiring transmitting a driving current of the printhead.

2. The printing apparatus according to claim 1, wherein the GND-side end of the detection resistance connects with the common wiring transmitting a load current in an internal portion of the printhead, and the detection resistance does not have a dedicated outgoing contact pad on a GND-side terminal.

3. The printing apparatus according to claim 1, wherein in a case where the GND-side end of the detection resistance connects with the common wiring transmitting a load current in an external portion of the printhead, the connection position is located in the middle of the printhead and an output voltage stable point of the power source circuit.

4. The printing apparatus according to claim 1, wherein a ratio of a wiring resistance value of the common wiring to a wiring resistance value of all wirings, connecting the power source circuit with the printhead and transmitting a head load current, is appropriately set in accordance with an output voltage so as to cancel a voltage drop in a load due to a wiring resistance.

* * * * *